US011443706B2

(12) United States Patent
Xu et al.

(10) Patent No.: US 11,443,706 B2
(45) Date of Patent: Sep. 13, 2022

(54) SHIFT REGISTER HAVING A COMPENSATION CIRCUIT, SHIFT REGISTER CIRCUIT AND DISPLAY DEVICE

(71) Applicants: Chongqing BOE Optoelectronics Technology Co., Ltd., Chongqing (CN); BOE TECHNOLOGY GROUP CO., LTD., Beijing (CN)

(72) Inventors: Zhuo Xu, Beijing (CN); Hailong Wu, Beijing (CN); Yajie Bai, Beijing (CN); Haipeng Zhu, Beijing (CN); Min Ran, Beijing (CN); Peng Liang, Beijing (CN); Zhi Zhang, Beijing (CN)

(73) Assignees: CHONGQING BOE OPTOELECTRONICS TECHNOLOGY CO., LTD., Chongqing (CN); Beijing BOE Technology Development Co., Ltd., Beijing (CN)

( * ) Notice: Subject to any disclaimer, the term of this patent is extended or adjusted under 35 U.S.C. 154(b) by 304 days.

(21) Appl. No.: 16/617,110

(22) PCT Filed: May 20, 2019

(86) PCT No.: PCT/CN2019/087650
§ 371 (c)(1),
(2) Date: Nov. 26, 2019

(87) PCT Pub. No.: WO2019/237889
PCT Pub. Date: Dec. 19, 2019

(65) Prior Publication Data

US 2022/0005428 A1 Jan. 6, 2022

(30) Foreign Application Priority Data

Jun. 12, 2018 (CN) ..... 201810602101.4

(51) Int. Cl.
*G09G 3/36* (2006.01)

(52) U.S. Cl.
CPC ... *G09G 3/3611* (2013.01); *G09G 2310/0286* (2013.01); *G09G 2310/08* (2013.01)

(58) Field of Classification Search
CPC ..... G09G 3/3611; G09G 2310/0286; G09G 2310/08
See application file for complete search history.

(56) References Cited

U.S. PATENT DOCUMENTS

2012/0262438 A1* 10/2012 Shang ..... G11C 19/28 345/211
2016/0307641 A1* 10/2016 Zheng ..... G09G 3/3677
(Continued)

FOREIGN PATENT DOCUMENTS

CN 102044206 A 5/2011
CN 102044206 B 4/2014
(Continued)

OTHER PUBLICATIONS

International Search Report and Written Opinion dated Jul. 29, 2019 for PCT Patent Application No. PCT/CN2019/087650.
(Continued)

*Primary Examiner* — Chad M Dicke
(74) *Attorney, Agent, or Firm* — Xsensus LLP

(57) ABSTRACT

A shift register includes an input circuit, a compensation circuit, an output circuit, a pull-down control circuit, a pull-down circuit, and a reset circuit. During operation of a pixel driving circuit, if a display abnormality occurs in one or more pixels corresponding to the shift register, a compensation signal may be provided by the compensation circuit to a pull-up node according to specific condition of the display abnormality, so as to change a voltage of the pull-up node, and further change a delay time of waveform
(Continued)

of the signal passing the switching element in the output circuit connected to the pull-up node.

16 Claims, 9 Drawing Sheets

(56) References Cited

U.S. PATENT DOCUMENTS

| | | | | |
|---|---|---|---|---|
| 2017/0221441 | A1* | 8/2017 | Gu | G09G 3/3677 |
| 2018/0293924 | A1 | 10/2018 | Wang | |

FOREIGN PATENT DOCUMENTS

| | | |
|---|---|---|
| CN | 104835476 | 8/2015 |
| CN | 105427830 | 3/2016 |
| CN | 105632565 | 6/2016 |
| CN | 105679262 | 6/2016 |
| CN | 106356015 | 1/2017 |
| CN | 106710507 | 5/2017 |
| CN | 107452425 | 12/2017 |
| CN | 107909960 | 4/2018 |
| CN | 108766340 | 11/2018 |
| CN | 108766383 | 11/2018 |
| CN | 109448630 | 3/2019 |
| EP | 3477646 | 5/2019 |
| KR | 20170105174 | 9/2017 |
| WO | 2019033783 | 2/2019 |

OTHER PUBLICATIONS

1st Office Action dated Sep. 12, 2019 for Chinese Patent Application No. 201810602101.4.

2nd Office Action dated Mar. 31, 2020 for Chinese Patent Application No. 201810602101.4.

* cited by examiner

SHIFT REGISTER HAVING A COMPENSATION CIRCUIT, SHIFT REGISTER CIRCUIT AND DISPLAY DEVICE

The present application is a national phase application under 35 U.S.C. § 371 of International Patent Application No. PCT/CN2019/087650, filed on May 20, 2019, which claims the benefit of and priority to Chinese Patent Application No. 201810602101.4, filed on Jun. 12, 2018, where both disclosures of which are hereby incorporated by reference in their entireties herein.

TECHNICAL FIELD

The present disclosure relates to the display technologies and, particularly, to a shift register, a shift register circuit, and a display device.

BACKGROUND

Due to low radiation, small size, and low energy consumption, liquid crystal displays have gradually replaced traditional cathode ray tube displays, and are widely used in notebook computers, personal digital assistants (PDA), flat-panel TVs, mobile phones, and other information products. The conventional liquid crystal display adopts an external gate driving chip to drive pixels on the panel for image display. In recent years, however, in order to reduce the number of components and reduce the manufacturing cost, the shift register structure has been developed as being directly provided on the display panel, that is, scanning signals are supplied to multiple rows of pixels via a shift register circuit including a plurality of shift registers.

It is desirable to provide a shift register or shift register circuit that can compensate for differences existing in the pixel charging rate for each row.

It should be noted that the information disclosed in this section is only for enhancing understanding the background of the present disclosure, and thus may include information that does not constitute prior art known to those of ordinary skill in the art.

SUMMARY

According to an aspect of the disclosure, there is provided a shift register, including:

an input circuit, connected to a pull-up node and being configured to provide a signal to the pull-up node;

a compensation circuit, connected to the pull-up node and being configured to transmit a compensation signal to the pull-up node, the compensation circuit being connected to the input circuit;

an output circuit, connected to the pull-up node, an output end and a first phase clock signal end, and being configured to transmit a signal of the first phase clock signal end to the output end in response to a signal of the pull-up node, the output circuit being connected to the input circuit and the compensation circuit;

a pull-down control circuit, connected to a first signal end, a pull-down control node, a pull-down node, the pull-up node and a second signal end, and being configured to transmit a signal of the second signal end to the pull-down node and the pull-down control node in response to the signal of the pull-up node, and transmit a signal of the first signal end to the pull-down control node and the pull-down node in response to the signal of the first signal end, the pull-down control circuit being connected to the input circuit;

a pull-down circuit, connected to the pull-up node, the pull-down node, the output end, and the second signal end, and being configured to transmit the signal of the second signal end to the pull-up node and the output end in response to a signal of the pull-down node, the pull-down circuit being connected between the compensation circuit and the output circuit; and a reset circuit, connected to a reset end, the second signal end and the pull-up node, and being configured to transmit the signal of the second signal end to the pull-up node in response to a signal of the reset end, the reset circuit being connected between the input circuit and the pull-down circuit.

In an exemplary embodiment of the disclosure, the input circuit includes:

a first switching element, provided with a control end and a first end connected to an input end, and a second end connected to the pull-up node;

the compensation circuit includes:

a tenth switching element, provided with a control end connected to the input end, a first end connected to a compensation end, and a second end connected to the pull-up node.

In an exemplary embodiment of the disclosure, the input circuit includes:

a first switching element, provided with a control end connected to an input end, a first end connected to the first signal end, and a second end connected to the pull-up node;

the compensation circuit includes:

a tenth switching element, provided with a control end connected to the input end, a first end connected to a compensation end, and a second end connected to the pull-up node.

In an exemplary embodiment of the disclosure, the input circuit includes:

a first switching element, provided with a control end and a first end connected to an input end, and a second end connected to the pull-up node;

the compensation circuit includes:

a tenth switching element, provided with a first end connected to a compensation end, and a second end connected to the pull-up node;

an eleventh switching element, provided with a control end and a first end connected to a second phase clock signal end, and a second end connected to a control end of the tenth switching element; and a twelfth switching element, provided with a control end connected to the pull-down node, a first end connected to the second end of the eleventh switching element, and a second end connected to the second signal end.

In an exemplary embodiment of the disclosure, the input circuit includes:

a first switching element, provided with a control end and a first end connected to an input end, and a second end connected to the pull-up node;

the compensation circuit includes:

a tenth switching element, provided with a first end connected to a compensation end;

an eleventh switching element, provided with a control end and a first end connected to the compensation end, and a second end connected to a control end of the tenth switching element;

a second storage capacitor, provided with a first end connected to a second end of the tenth switching element, and a second end connected to the pull-up node; and a twelfth switching element, provided with a control end connected to the pull-down node, a first end connected to a second end of the eleventh switching element, and a second end connected to the second signal end.

In an exemplary embodiment of the disclosure, the output circuit includes:

a second switching element, provided with a control end connected to the pull-up node, a first end connected to the first phase clock signal end, and a second end connected to the output end; and a first storage capacitor, provided with a first end connected to the pull-up node, and a second end connected to the output end;

the pull-down control circuit includes:

a third switching element, provided with a control end and a first end connected to the first signal end, and a second end connected to the pull-down control node;

a fourth switching element, provided with a control end connected to the pull-down control node, a first end connected to the first signal end, and a second end connected to the pull-down node;

a fifth switching element, provided with a control end connected to the pull-up node, a first end connected to the pull-down control node, and a second end connected to the second signal end; and a sixth switching element, provided with a control end connected to the pull-up node, a first end connected to the pull-down node, and a second end connected to the second signal end;

the pull-down circuit includes:

a seventh switching element, provided with a control end connected to the pull-down node, a first end connected to the pull-up node, and a second end connected to the second signal end; and an eighth switching element, provided with a control end connected to the pull-down node, a first end connected to the output end, and a second end connected to the second signal end;

the reset circuit includes:

a ninth switching element, provided with a control end connected to the reset end, a first end connected to the pull-up node, and a second end connected to the second signal end.

According to an aspect of the disclosure, there is provided a shift register circuit, including:

N cascading shift registers according to any embodiment described above, wherein, the second signal ends of the shift registers at respective stages are provided signals according to display states of pixels corresponding to the shift registers at respective stages.

In an exemplary embodiment of the disclosure, the pull-down circuit of the shift register includes a first pull-down circuit and a second pull-down circuit, the second signal end includes a first sub-signal end and a second sub-signal end;

the first pull-down circuit includes: an eighth switching element, provided with a control end connected to the pull-down node, a first end connected to the output end, and a second end connected to the first sub-signal end, and being configured to transmit a signal of the first sub-signal end to the output end in response to the signal of the pull-down node;

the second pull-down circuit includes: a seventh switching element, provided with a control end connected to the pull-down node, a first end connected to the pull-up node, and a second end connected to the second signal end, and being configured to transmit a signal of the second sub-signal end to the pull-up node in response to the signal of the pull-down node;

the reset circuit of the shift register is connected to the reset end, the pull-up node, and the second sub-signal end, and being configured to transmit the signal of the second sub-signal end to the pull-up node in response to a signal of the reset end node.

In an exemplary embodiment of the disclosure, the signal of the first sub-signal end includes a first signal to an N-th signal;

the second signal ends of the shift registers at respective stages are provided signals according to display states of pixels corresponding to the shift registers at respective stages by:

according to a cascade relationship of the shift registers, the first sub-signal ends of the shift registers at a first stage to an N-th stage sequentially receiving the N-th signal to the first signal; and according to the cascade relationship of the shift registers, the second sub-signal ends of the shift registers at the first stage to the N-th stage receiving the first signal.

In an exemplary embodiment of the disclosure, the signal of the first sub-signal end includes a first signal to an (N+1)-th signal;

the second signal ends of the shift registers at respective stages are provided signals according to display states of pixels corresponding to the shift registers at respective stages by:

according to a cascade relationship of the shift register, the first sub-signal ends of the shift registers at a first stage to an N-th stage sequentially receiving the (N+1)-th signal to a second signal; and according to the cascade relationship of the shift registers, the second sub-signal ends of the shift registers at the first stage to the N-th stage sequentially receiving the N-th signal to the first signal.

According to an aspect of the disclosure, there is provided a display device, including the shift register according to any embodiment described above and the shift register circuit according to any embodiment described above.

BRIEF DESCRIPTION OF THE DRAWINGS

The above and other features and advantages of the present disclosure will become more apparent from the detailed description of exemplary embodiments. It is understood that the drawings in the following description are only some of the embodiments of the present disclosure, and other drawings may be obtained from those skilled in the art without departing from the drawings. In the drawings.

DETAILED DESCRIPTION

Figure 1:
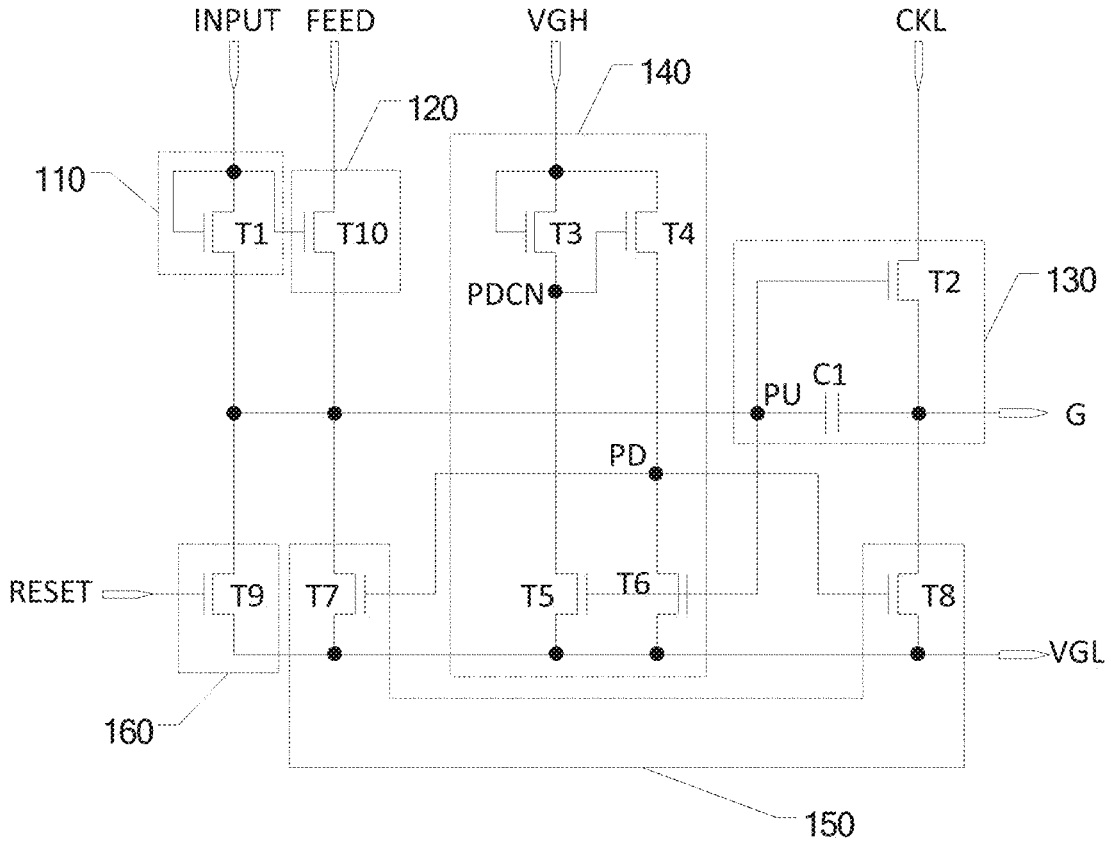
FIG. 1 is a schematic structural diagram I illustrating a shift register according to an exemplary embodiment of the present disclosure.

Example embodiments will now be described more fully with reference to the accompanying drawings. However, the embodiments can be implemented in a variety of forms and should not be construed as being limited to the examples set forth herein; rather, these embodiments are provided so that this disclosure will be more complete so as to convey the idea of the exemplary embodiments to those skilled in this art. The described features, structures, or characteristics in one or more embodiments may be combined in any suitable manner. In the following description, numerous specific details are set forth. However, those skilled in the art will appreciate that the technical solution of the present disclosure may be practiced without one or more of the specific details, or by adopting other methods, components, materials, devices, steps, and the like. In other instances, well-known technical solutions are not shown or described in detail to avoid obscuring aspects of the present disclosure.

In addition, the drawings are merely schematic representations of the present disclosure and are not necessarily drawn to scale. The same reference numerals in the drawings denote the same or similar parts, and the repeated description thereof will be omitted.

Currently, a shift register circuit having a plurality of cascaded shift registers is often used to provide scanning signals to pixels of different rows. However, during the operation of cascaded shift registers, due to prolonged operation, ambient temperature, manufacturing process instability, or relatively large resistance of a scanning line between a certain stage shift register and its corresponding pixel, a difference may be caused in the scanning signal output from output ends of partial shift registers or in the delay time (i.e., rise time and fall time) of the scanning signal transmitted to the pixels, so that the charge rate of each row of pixels has different degrees of difference. Further, the display brightness of each row of pixels may be different, and defects such as X-thin dark lines, H-BLOCK (horizontal block display), horizontal stripes, and the like occur.

According to embodiments of the disclosure, there is provided a shift register, including: an input circuit, a compensation circuit, an output circuit, a pull-down control circuit, a pull-down circuit, and a reset circuit.

The input circuit is connected to a pull-up node and is configured to provide a signal to the pull-up node.

The compensation circuit is connected to the pull-up node and is configured to transmit a compensation signal to the pull-up node.

The output circuit is connected to the pull-up node, an output end and a first phase clock signal end, and is configured to transmit a signal of the first phase clock signal end to the output end in response to a signal of the pull-up node.

The pull-down control circuit is connected to a first signal end, a pull-down control node, a pull-down node, the pull-up node and a second signal end, and is configured to transmit a signal of the second signal end to the pull-down node and the pull-down control node in response to the signal of the pull-up node, and transmit a signal of the first signal end to the pull-down control node and the pull-down node in response to the signal of the first signal end.

The pull-down circuit is connected to the pull-up node, the pull-down node, the output end and the second signal end, and is configured to transmit the signal of the second signal end to the pull-up node and the output end in response to a signal of the pull-down node.

The reset circuit is connected to a reset end, the second signal end, and the pull-up node, and is configured to transmit the signal of the second signal end to the pull-up node in response to a signal of the reset end.

During operation of a pixel driving circuit, if a display abnormality occurs in pixels corresponding to the shift register, a compensation signal may be provided by the compensation circuit to the pull-up node according to specific condition of the display abnormality, so as to change a voltage of the pull-up node, and further change a delay time of waveform of the signal passing the switching element in the output circuit connected to the pull-up node. Accordingly, the delay time of the scanning signal output by the shift register is improved, thereby improving a charging rate of the pixels corresponding to the shift register, ensuring uniformity of displayed brightness of pixels, and eliminating undesirable phenomena such as X-thin dark lines, H-BLOCK, and horizontal stripes.

Hereinafter, the specific structure and connection manner of each circuit in the above shift register will be described in detail in the following four embodiments.

Embodiment I

As shown in FIG. 1, the shift register may include: an input circuit 110, a compensation circuit 120, an output circuit 130, a pull-down control circuit 140, a pull-down circuit 150, and a reset circuit 160. The compensation circuit 120 is connected to the input circuit 110. The output circuit 130 is connected to the input circuit 110 and the compensation circuit 120. The pull-down control circuit 140 is connected to the input circuit 110. The pull-down circuit 150 is connected between the compensation circuit 120 and the output circuit 130. The reset circuit 160 is connected between the input circuit 110 and the pull-down circuit 150.

The input circuit 110 includes:

a first switching element T1, provided with a control end and a first end connected to an input end INPUT, and a second end connected to the pull-up node PU.

The compensation circuit 120 includes:

a tenth switching element T10, provided with a control end connected to the input end INPUT, a first end connected to a compensation end FEED, and a second end connected to the pull-up node PU.

The output circuit 130 includes:

a second switching element T2, provided with a control end connected to the pull-up node PU, a first end connected to the first phase clock signal end CKL, and a second end connected to the output end G; and a first storage capacitor C1, provided with a first end connected to the pull-up node PU, and a second end connected to the output end G.

The pull-down control circuit 140 includes:

a third switching element T3, provided with a control end and a first end connected to the first signal end VGH, and a second end connected to the pull-down control node PDCN;

a fourth switching element T4, provided with a control end connected to the pull-down control node PDCN, a first end connected to the first signal end VGH, and a second end connected to the pull-down node PD;

a fifth switching element T5, provided with a control end connected to the pull-up node PU, a first end connected to the pull-down control node PDCN, and a second end connected to the second signal end VGL; and a sixth switching element T6, provided with a control end connected to the pull-up node PU, a first end connected to the pull-down node PD, and a second end connected to the second signal end VGL.

The pull-down circuit 150 includes:

a seventh switching element T7, provided with a control end connected to the pull-down node PD, a first end connected to the pull-up node PU, and a second end connected to the second signal end VGL; and an eighth switching element T8, provided with a control end connected to the pull-down node PD, a first end connected to the output end G, and a second end connected to the second signal end VGL.

The reset circuit 160 includes:

a ninth switching element T9, provided with a control end connected to the reset end RESET, a first end connected to the pull-up node PU, and a second end connected to the second signal end VGL.

In the exemplary embodiment, the first to tenth switching elements (T1 to T10) may respectively correspond to a first to tenth switching transistors, and each of the switching transistors has a control end, a first end, and a second end. Specifically, the control end of each switching transistor may be a gate, the first end may be a source, and the second end may be a drain. Alternatively, the control end of each switching transistor may be a gate, the first end may be a drain, and the second end may be a source. In addition, each of the switching transistors may be an enhancement transistor or a depletion transistor, which is not specifically limited in this exemplary embodiment. Moreover, each of the switching transistors may be an N-type transistor or a P-type transistor, which is not specifically limited in this exemplary embodiment.

The operation of the shift register in FIG. 1 will be described below by taking an example in which all switching elements are N-type thin film transistors. Since the switching elements are N-type thin film transistors, on signals of all the switching elements are high level signals, and off signals of all switching elements are low level signals.

In a pixel holding phase, a signal of the reset end RESET, a signal of the input end INPUT, and a signal of the second signal end VGL are all low level signals, and a signal of the first signal end VGH and a signal of the first phase clock signal end CKL are both high level signals. At this time, the third switching element T3 is turned on by the signal of the first signal end VGH, and transmits the signal of the first signal end VGH to the pull-down control node PDCN. The fourth switching element T4 is turned on by the pull-down control node PDCN, and transmits the signal of the first signal end VGH to the pull-down node PD. The seventh switching element T7 and the eighth switching element T8 are turned on by the signal of the first signal end VGH and transmitted to the pull-down node PD, and transmit the signal of the second signal end VGL to the pull-up node PU and the output end G, so as to continuously perform noise reducing to the pull-up node PU and the output end G through the signal of the second signal end VGL. At the same time, the fifth switching element T5, the sixth switching element T6, and the second switching element T2 are turned off by the signal of the second signal end VGL and transmitted to the pull-up node PU, the first switching element T1 and the tenth switching element T10 are turned off by the signal of the input end INPUT, and the ninth switching element T9 is turned off by the signal of the reset end RESET. It should be noted that, at this time, the scanning signal output by the output end G is the signal of the second signal end VGL, that is, the low level signal.

In a charging phase, the signal of the input end INPUT and the signal of the first signal end VGH are high level signals, and the signal of the reset end RESET, the signal of the second signal end VGL, and the signal of the first phase clock signal end CKL are all low level signals. At this time, the first switching element T1 and the tenth switching element T10 are turned on by the signal of the input end INPUT, and the signal of the input end INPUT and the compensation signal of the compensation end FEED are transmitted to the pull-up node PU. Accordingly, the signal of the pull-up node PU is a parallel signal of the signal of the input end INPUT and the compensation signal of the compensation end FEED, and the first storage capacitor C1 is charged by the parallel signal. The fifth switching element T5 and the sixth switching element T6 are turned on by the signal of the pull-up node PU, transmit the signal of the second signal end VGL to the pull-down node PD and the pull-down control node PDCN. The seventh switching element T7 and the eighth switching element T8 are turned off by the signal of the second signal end VGL and transmitted to the pull-down node PD. The second switching element T2 is turned on by the signal of the pull-up node PU, and transmits the signal of the first phase clock signal end CKL to the output end G. Since the signal of the first phase clock signal end CKL is the low level signal, the scanning signal output by the output end G is the low level signal.

In a bootstrap phase, the signal of the first signal end VGH and the signal of the first phase clock signal end CKL are high level signals, the signal of the reset end RESET, the signal of the second signal end VGL, and the signal of the input end INPUT are low level signals. The second switching element T2 is turned on under the action of the first storage capacitor C1, that is, the second switching element T2 is turned on by the parallel signal of the signal of the input end INPUT and the compensation signal of the compensation end FEED, which is stored at the first storage capacitor C1. The signal of the first phase clock signal end CKL is transmitted to the output end G. Since the signal of the first phase clock signal end CKL is the high level signal, the scanning signal output by the output end G is the high level signal. In addition, due to the bootstrap action of the first storage capacitor C1, a potential of the pull-up node PU is bootstrapped from the parallel signal of the signal of the input end INPUT and the compensation signal of the compensation end FEED to a sum of the signal of the first phase clock signal end CKL and the parallel signal of the signal of the input end INPUT and the compensation signal of the compensation end FEED.

In a reset phase, the signal of the reset end RESET and the signal of the first signal end VGH are high level signals, the signal of the second signal end VGL, the signal of the input end INPUT, and the signal of the first phase clock signal end CKL are all low level signals. The ninth switching element T9 is turned on by the signal of the reset end RESET and transmits the signal of the second signal end VGL to the pull-up node PU, thereby resetting the pull-up node PU. As the signal of the pull-up node PU is low level signal at this time, the fifth switching element T5 and the sixth switching element T6 are turned off. The third switching element T3 and the fourth switching element T4 are turned on by the signal of the first signal end VGH, and the signal of the first signal end VGH is transmitted to the pull-down node PD. The seventh switching element T7 and the eighth switching element T8 are turned on by the signal of the first signal end VGH, and the signal of the second signal end VGL is transmitted to the pull-up node PU and the output end G. Accordingly, the scanning signal output by the output end G is the signal of the second signal end VGL, that is, the low level signal.

Figure 2:
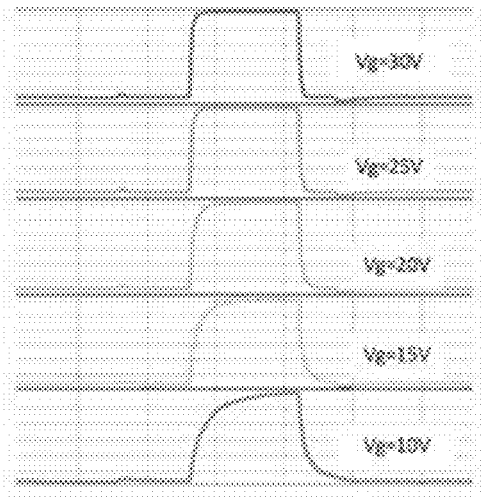
FIG. 2 is a schematic diagram illustrating a relationship between a signal of a gate of a switching element and a delay time of a signal passing through the switching element according to an exemplary embodiment of the present disclosure.

FIG. 2 shows the relationship between the signal Vg of the gate (i.e., the control end) of the switching element and the delay time of the signal passing through the switching element, wherein the switching element is an N-type transistor. As can be seen from the figure, the larger the signal Vg at the gate (i.e., the control end) of the switching element, the shorter the delay time of the signal output through the switching element. Moreover, the shorter the delay time of the signal, the higher the charging rate acting on the pixel; the longer the delay time of the signal, the lower the charging rate acting on the pixel. Therefore, the larger the signal Vg at the gate (i.e., the control end) of the switching element, the higher the charging rate acting on the pixel; the smaller the signal Vg at the gate (i.e., the control end) of the switching element, the lower the charging rate acting on the pixel.

Based on the above principle, during the operation process of the above shift register, in the charging phase, the signal transmitted to the pull-up node PU and the signal stored at the first storage capacitor C1 are the parallel signal of the signal of the input end INPUT and the compensation signal of the compensation end FEED. Accordingly, when the pixel corresponding to the shift register does not exhibit a display abnormality, the compensation signal of the compensation end FEED may be set to the same as the signal of the input end INPUT, so that in the charging phase, the signal of the pull-up node PU and the signal stored at the first storage capacitor C1 is still the signal of the input end INPUT (that is, the signal of the control end of the second switching element T2 is still the signal of the input end INPUT), ensuring that the newly added compensation circuit 120 does not cause influence on the shift register. When a display abnormality occurs in the pixel corresponding to the shift register, the magnitude of the compensation signal input by the compensation end FEED may be determined according to the specific situation of the display abnormality, so that in the charging phase, the parallel signal of the signal of the input end INPUT and the compensation signal of the compensation end FEED, which is transmitted to the pull-up node PU and stored at the first storage capacitor C1, may be changed, thereby changing the delay time of the signal from the first phase clock signal end CKL passing through the second switching element T2. Correspondingly, the delay time of scanning signals output by the shift register is improved, thereby improving the charging rate of the pixel corresponding to the shift register, ensures uniformity of displayed brightness of pixels, and eliminating undesirable phenomena such as X-thin dark lines, H-BLOCK, and horizontal stripes.

Embodiment II

Figure 3:
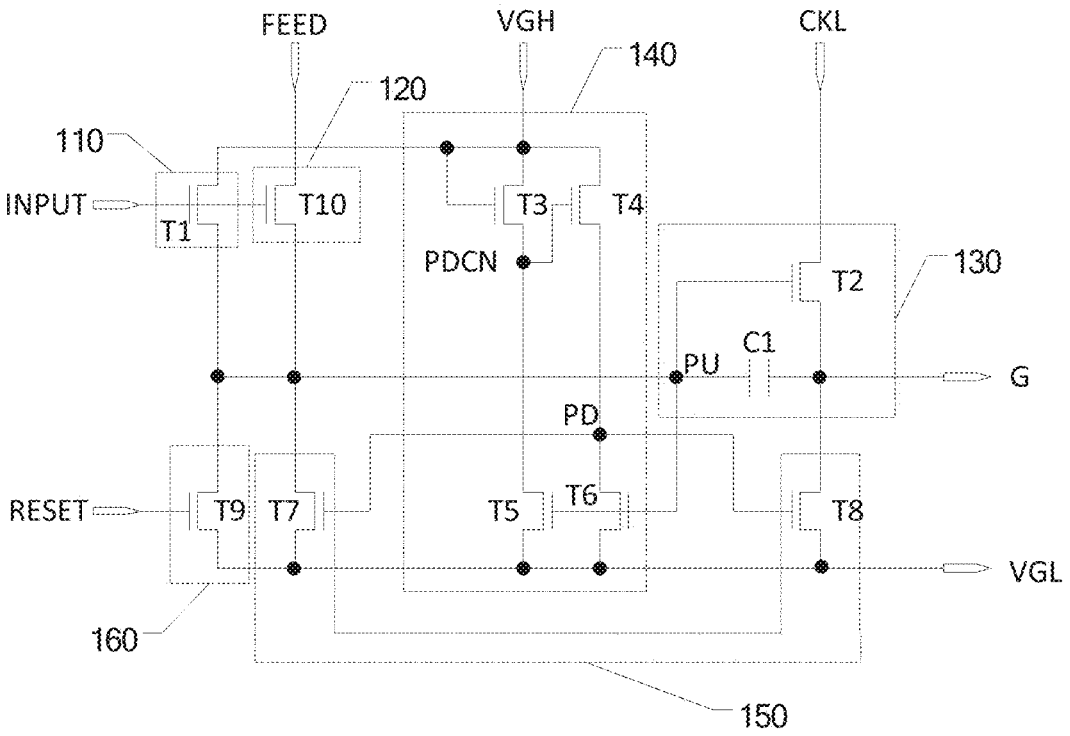
FIG. 3 is a schematic structural diagram II illustrating a shift register according to an exemplary embodiment of the present disclosure.

As shown in FIG. 3, the shift register may include: an input circuit 110, a compensation circuit 120, an output circuit 130, a pull-down control circuit 140, a pull-down circuit 150, and a reset circuit 160. The compensation circuit 120 is connected to the input circuit 110. The output circuit 130 is connected to the input circuit 110 and the compensation circuit 120. The pull-down control circuit 140 is connected to the input circuit 110. The pull-down circuit 150 is connected between the compensation circuit 120 and the output circuit 130. The reset circuit 160 is connected between the input circuit 110 and the pull-down circuit 150.

The input circuit 110 includes:

a first switching element T1, provided with a control end connected to an input end INPUT, a first end connected to the first signal end VGH, and a second end connected to the pull-up node PU.

The compensation circuit 120 includes:

a tenth switching element T10, provided with a control end connected to the input end INPUT, a first end connected to a compensation end FEED, and a second end connected to the pull-up node PU.

The output circuit 130 includes:

a second switching element T2, provided with a control end connected to the pull-up node PU, a first end connected to the first phase clock signal end CKL, and a second end connected to the output end G; and a first storage capacitor C1, provided with a first end connected to the pull-up node PU, and a second end connected to the output end G.

The pull-down control circuit 140 includes:

a third switching element T3, provided with a control end and a first end connected to the first signal end VGH, and a second end connected to the pull-down control node PDCN;

a fourth switching element T4, provided with a control end connected to the pull-down control node PDCN, a first end connected to the first signal end VGH, and a second end connected to the pull-down node PD;

a fifth switching element T5, provided with a control end connected to the pull-up node PU, a first end connected to the pull-down control node PDCN, and a second end connected to the second signal end VGL; and a sixth switching element T6, provided with a control end connected to the pull-up node PU, a first end connected to the pull-down node PD, and a second end connected to the second signal end VGL.

The pull-down circuit 150 includes:

a seventh switching element T7, provided with a control end connected to the pull-down node PD, a first end connected to the pull-up node PU, and a second end connected to the second signal end VGL; and an eighth switching element T8, provided with a control end connected to the pull-down node PD, a first end connected to the output end G, and a second end connected to the second signal end VGL.

The reset circuit 160 includes:

a ninth switching element T9, provided with a control end connected to the reset end RESET, a first end connected to the pull-up node PU, and a second end connected to the second signal end VGL.

In the exemplary embodiment, the first to tenth switching elements (T1 to T10) may respectively correspond to a first to tenth switching transistors, and each of the switching transistors has a control end, a first end, and a second end. Specifically, the control end of each switching transistor may be a gate, the first end may be a source, and the second end may be a drain. Alternatively, the control end of each switching transistor may be a gate, the first end may be a drain, and the second end may be a source. In addition, each of the switching transistors may be an enhancement transistor or a depletion transistor, which is not specifically limited in this exemplary embodiment. Moreover, each of the switching transistors may be an N-type transistor or a P-type transistor, which is not specifically limited in this exemplary embodiment.

The operation of the shift register in FIG. 3 will be described below by taking an example in which all switching elements are N-type thin film transistors. Since the switching elements are N-type thin film transistors, on signals of all the switching elements are high level signals, and off signals of all switching elements are low level signals.

In a pixel holding phase, a signal of the reset end RESET, a signal of the input end INPUT, and a signal of the second signal end VGL are all low level signals, and a signal of the first signal end VGH and a signal of the first phase clock signal end CKL are both high level signals. At this time, the third switching element T3 is turned on by the signal of the first signal end VGH, and transmits the signal of the first signal end VGH to the pull-down control node PDCN. The fourth switching element T4 is turned on by the pull-down control node PDCN, and transmits the signal of the first signal end VGH to the pull-down node PD. The seventh switching element T7 and the eighth switching element T8 are turned on by the signal of the first signal end VGH and transmitted to the pull-down node PD, and transmit the signal of the second signal end VGL to the pull-up node PU and the output end G, so as to continuously perform noise reducing to the pull-up node PU and the output end G through the signal of the second signal end VGL. At the same time, the fifth switching element T5, the sixth switching element T6, and the second switching element T2 are turned off by the signal of the second signal end VGL and transmitted to the pull-up node PU, the first switching element T1 and the tenth switching element T10 are turned off by the signal of the input end INPUT, and the ninth switching element T9 is turned off by the signal of the reset end RESET. It should be noted that, at this time, the scanning signal output by the output end G is the signal of the second signal end VGL, that is, the low level signal.

In a charging phase, the signal of the input end INPUT and the signal of the first signal end VGH are high level signals, and the signal of the reset end RESET, the signal of the second signal end VGL, and the signal of the first phase clock signal end CKL are all low level signals. At this time, the first switching element T1 and the tenth switching element T10 are turned on by the signal of the input end INPUT, and the signal of the first signal end VGH and the compensation signal of the compensation end FEED are transmitted to the pull-up node PU. Accordingly, the signal of the pull-up node PU is a parallel signal of the signal of the first signal end VGH and the compensation signal of the compensation end FEED, and the first storage capacitor C1 is charged by the parallel signal. The fifth switching element T5 and the sixth switching element T6 are turned on by the signal of the pull-up node PU, transmit the signal of the second signal end VGL to the pull-down node PD and the pull-down control node PDCN. The seventh switching element T7 and the eighth switching element T8 are turned off by the signal of the second signal end VGL and transmitted to the pull-down node PD. The second switching element T2 is turned on by the signal of the pull-up node PU, and transmits the signal of the first phase clock signal end CKL to the output end G. Since the signal of the first phase clock signal end CKL is the low level signal, the scanning signal output by the output end G is the low level signal.

In a bootstrap phase, the signal of the first signal end VGH and the signal of the first phase clock signal end CKL are high level signals, the signal of the reset end RESET, the signal of the second signal end VGL, and the signal of the input end INPUT are low level signals. The second switching element T2 is turned on under the action of the first storage capacitor C1, that is, the second switching element T2 is turned on by the parallel signal of the signal of the first signal end VGH and the compensation signal of the compensation end FEED, which is stored at the first storage capacitor C1. The signal of the first phase clock signal end CKL is transmitted to the output end G. Since the signal of the first phase clock signal end CKL is the high level signal, the scanning signal output by the output end G is the high level signal. In addition, due to the bootstrap action of the first storage capacitor C1, a potential of the pull-up node PU is bootstrapped from the parallel signal of the signal of the first signal end VGH and the compensation signal of the compensation end FEED to a sum of the signal of the first phase clock signal end CKL and the parallel signal of the signal of the first signal end VGH and the compensation signal of the compensation end FEED.

In a reset phase, the signal of the reset end RESET and the signal of the first signal end VGH are high level signals, and the signal of the second signal end VGL, the signal of the input end INPUT, and the signal of the first phase clock signal end CKL are all low level signals. The ninth switching element T9 is turned on by the signal of the reset end RESET, and transmits the signal of the second signal end VGL to the pull-up node PU, thereby resetting the pull-up node PU. As the signal of the pull-up node PU is low level signal at this time, the fifth switching element T5 and the sixth switching element T6 are turned off. The third switching element T3 and the fourth switching element T4 are turned on by the signal of the first signal end VGH, and the signal of the first signal end VGH is transmitted to the pull-down node PD. The seventh switching element T7 and the eighth switching element T8 are turned on by the signal of the first signal end VGH, and the signal of the second signal end VGL is transmitted to the pull-up node PU and the output end G. Accordingly, the scanning signal output by the output end G is the low level signal.

Since the relationship between the signal of the gate (i.e., the control end) of the switching element and the charging rate of the pixel has been described above, it will not be described herein.

Based on the above principle, during the operation process of the above shift register, in the charging phase, the signal transmitted to the pull-up node PU and the signal stored at the first storage capacitor C1 are the parallel signal of the signal of the first signal end VGH and the compensation signal of the compensation end FEED. Accordingly, when the pixel corresponding to the shift register does not exhibit a display abnormality, the compensation signal of the compensation end FEED may be set to the same as the signal of the first signal end VGH, so that in the charging phase, the signal of the pull-up node PU and the signal stored at the first storage capacitor C1 is still the signal of the first signal end VGH (that is, the signal of the control end of the second switching element T2 is still the signal of the first signal end VGH), ensuring that the newly added compensation circuit 120 does not cause influence on the shift register. When a display abnormality occurs in the pixel corresponding to the shift register, the magnitude of the compensation signal input by the compensation end FEED may be determined according to the specific situation of the display abnormality, so that in the charging phase, the parallel signal of the signal of the first signal end VGH and the compensation signal of the compensation end FEED, which is transmitted to the pull-up node PU and stored at the first storage capacitor C1, may be changed, thereby changing the delay time of the signal from the first phase clock signal end CKL passing through the second switching element T2. Correspondingly, the delay time of scanning signals output by the shift register is improved, thereby improving the charging rate of the pixel corresponding to the shift register, ensures uniformity of displayed brightness of pixels, and eliminating undesirable phenomena such as X-thin dark lines, H-BLOCK, and horizontal stripes.

Embodiment III

Figure 4:
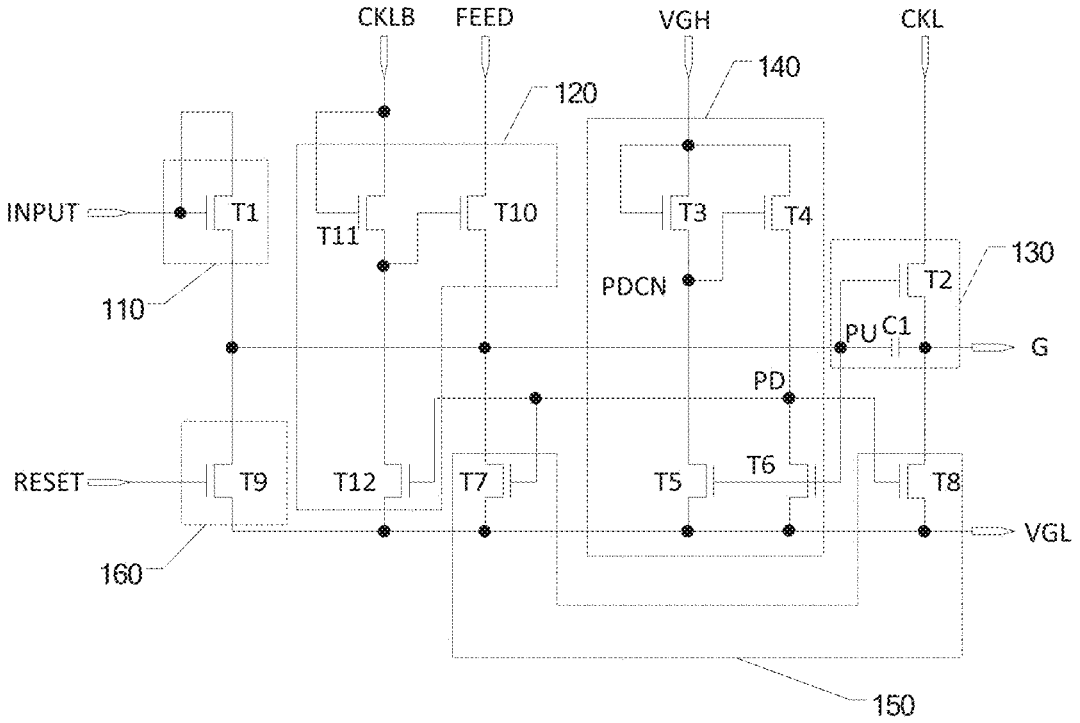
FIG. 4 is a schematic structural diagram III illustrating a shift register according to an exemplary embodiment of the present disclosure.

As shown in FIG. 4, the shift register may include: an input circuit 110, a compensation circuit 120, an output circuit 130, a pull-down control circuit 140, a pull-down circuit 150, and a reset circuit 160. The compensation circuit 120 is connected to the input circuit 110. The output circuit 130 is connected to the input circuit 110 and the compensation circuit 120. The pull-down control circuit 140 is connected to the input circuit 110. The pull-down circuit 150 is connected between the compensation circuit 120 and the output circuit 130. The reset circuit 160 is connected between the input circuit 110 and the pull-down circuit 150.

The input circuit 110 includes:

a first switching element T1, provided with a control end and a first end connected to an input end INPUT, and a second end connected to the pull-up node PU.

The compensation circuit 120 includes:

a tenth switching element T10, provided with a first end connected to a compensation end FEED, and a second end connected to the pull-up node PU;

an eleventh switching element T11, provided with a control end and a first end connected to a second phase clock signal end CKLB, and a second end connected to a control end of the tenth switching element T10; and a twelfth switching element T12, provided with a control end connected to the pull-down node PD, a first end connected to the second end of the eleventh switching element T11, and a second end connected to the second signal end VGL.

The output circuit 130 includes:

a second switching element T2, provided with a control end connected to the pull-up node PU, a first end connected to the first phase clock signal end CKL, and a second end connected to the output end G; and a first storage capacitor C1, provided with a first end connected to the pull-up node PU, and a second end connected to the output end G.

The pull-down control circuit 140 includes:

a third switching element T3, provided with a control end and a first end connected to the first signal end VGH, and a second end connected to the pull-down control node PDCN;

a fourth switching element T4, provided with a control end connected to the pull-down control node PDCN, a first end connected to the first signal end VGH, and a second end connected to the pull-down node PD;

a fifth switching element T5, provided with a control end connected to the pull-up node PU, a first end connected to the pull-down control node PDCN, and a second end connected to the second signal end VGL; and a sixth switching element T6, provided with a control end connected to the pull-up node PU, a first end connected to the pull-down node PD, and a second end connected to the second signal end VGL.

The pull-down circuit 150 includes:

a seventh switching element T7, provided with a control end connected to the pull-down node PD, a first end connected to the pull-up node PU, and a second end connected to the second signal end VGL; and an eighth switching element T8, provided with a control end connected to the pull-down node PD, a first end connected to the output end G, and a second end connected to the second signal end VGL.

The reset circuit 160 includes:

a ninth switching element T9, provided with a control end connected to the reset end RESET, a first end connected to the pull-up node PU, and a second end connected to the second signal end VGL.

In the exemplary embodiment, the first to twelfth switching elements (T1 to T12) may respectively correspond to a first to twelfth switching transistors, and each of the switching transistors has a control end, a first end and a second end. Specifically, the control end of each switching transistor may be a gate, the first end may be a source, and the second end may be a drain. Alternatively, the control end of each switching transistor may be a gate, and the first end may be a drain, the second end may be a source. In addition, each of the switching transistors may be an enhancement transistor or a depletion transistor, which is not specifically limited in this exemplary embodiment. Moreover, each of the switching transistors may be an N-type transistor or a P-type transistor, which is not specifically limited in this exemplary embodiment.

The operation of the shift register in FIG. 4 will be described below by taking an example in which all switching elements are N-type thin film transistors. Since the switching elements are N-type thin film transistors, on signals of all the switching elements are high level signals, and off signals of all switching elements are low level signals. It should be noted that the signal of the first phase clock signal terminal CKL and the signal of the second phase clock signal terminal CKLB are the same in frequency but opposite in phase.

In a pixel holding phase, a signal of the reset end RESET, a signal of the input end INPUT, a signal of the second signal end VGL and the signal of the second phase clock signal terminal CKLB are all low level signals, and a signal of the first signal end VGH and a signal of the first phase clock signal end CKL are both high level signals. At this time, the third switching element T3 is turned on by the signal of the first signal end VGH, and transmits the signal of the first signal end VGH to the pull-down control node PDCN. The fourth switching element T4 is turned on by the pull-down control node PDCN, and transmits the signal of the first signal end VGH to the pull-down node PD. The seventh switching element T7, the eighth switching element T8 and the twelfth switching element T12 are turned on by the signal of the first signal end VGH and transmitted to the pull-down node PD, and transmit the signal of the second signal end VGL to the pull-up node PU, the output end G and the control end of the tenth switching element T10, so as to continuously perform noise reducing to the pull-up node PU and the output end G through the signal of the second signal end VGL. At the same time, the fifth switching element T5, the sixth switching element T6, and the second switching element T2 are turned off by the signal of the second signal end VGL and transmitted to the pull-up node PU, the first switching element T1 is turned off by the signal of the input end INPUT, the ninth switching element T9 is turned off by the signal of the reset end RESET, and the eleventh switching element T11 is turned off by the signal of the second phase clock signal terminal CKLB. Since the signal of the second signal end VGL is the low level signal, the scanning signal output by the output end G is low level signal.

In a charging phase, the signal of the input end INPUT, the signal of the first signal end VGH and the signal of the second phase clock signal terminal CKLB are high level signals, the signal of the reset end RESET, the signal of the second signal end VGL, and the signal of the first phase clock signal end CKL are all low level signals. At this time, the first switching element T1 is turned on, and the signal of the input end INPUT is transmitted to the pull-up node PU. At the same time, the eleventh switching element is turned on by the signal of the second phase clock signal terminal CKLB, and transmits the signal of the second phase clock signal terminal CKLB to the control end of the tenth switching element T10, turning on the tenth switching element T10 to transmit the compensation signal of the compensation end FEED to the pull-up node PU. Accordingly, the signal of the pull-up node PU is a parallel signal of the signal of the input end INPUT and the compensation signal of the compensation end FEED, and the first storage capacitor C1 is charged by the parallel signal. The fifth switching element T5 and the sixth switching element T6 are turned on by the signal of the pull-up node PU, transmit the signal of the second signal end VGL to the pull-down node PD and the pull-down control node PDCN. The seventh switching element T7, the eighth switching element T8 and the twelfth switching element T12 are turned off by the signal of the second signal end VGL and transmitted to the pull-down node PD. The second switching element T2 is turned on by the signal of the pull-up node PU, and transmits the signal of the first phase clock signal end CKL to the output end G. Since the signal of the first phase clock signal end CKL is the low level signal, the scanning signal output by the output end G is the low level signal.

In a bootstrap phase, the signal of the first signal end VGH and the signal of the first phase clock signal end CKL are high level signals, the signal of the reset end RESET, the signal of the second signal end VGL, the signal of the input end INPUT and the signal of the second phase clock signal terminal CKLB are low level signals. The second switching element T2 is turned on under the action of the first storage capacitor C1, that is, the second switching element T2 is turned on by the parallel signal of the signal of the input end INPUT and the compensation signal of the compensation end FEED, which is stored at the first storage capacitor C1. The signal of the first phase clock signal end CKL is transmitted to the output end G. Since the signal of the first phase clock signal end CKL is the high level signal, the scanning signal output by the output end G is the high level signal. In addition, due to the bootstrap action of the first storage capacitor C1, a potential of the pull-up node PU is bootstrapped from the parallel signal of the signal of the input end INPUT and the compensation signal of the compensation end FEED to a sum of the signal of the first phase clock signal end CKL and the parallel signal of the signal of the input end INPUT and the compensation signal of the compensation end FEED.

In a reset phase, the signal of the reset end RESET, the signal of the first signal end VGH and the signal of the second phase clock signal terminal CKLB are high level signals, the signal of the second signal end VGL, the signal of the input end INPUT, and the signal of the first phase clock signal end CKL are all low level signals. The ninth switching element T9 is turned on by the signal of the reset end RESET, and transmits the signal of the second signal end VGL to the pull-up node PU, thereby resetting the pull-up node PU. As the signal of the pull-up node PU is low level signal at this time, the fifth switching element T5 and the sixth switching element T6 are turned off. The third switching element T3 and the fourth switching element T4 are turned on by the signal of the first signal end VGH, and the signal of the first signal end VGH is transmitted to the pull-down node PD. The seventh switching element T7, the eighth switching element T8 and the twelfth switching element T12 are turned on by the signal of the first signal end VGH, and the signal of the second signal end VGL is transmitted to the pull-up node PU, the output end G and the control end of the tenth switching element T10. Accordingly, the scanning signal output by the output end G is low level signal.

Since the relationship between the signal of the gate (i.e., the control end) of the switching element and the charging rate of the pixel has been described above, it will not be described herein.

Based on the above principle, during the operation process of the above shift register, in the charging phase, the signal transmitted to the pull-up node PU and the signal stored at the first storage capacitor C1 are the parallel signal of the signal of the input end INPUT and the compensation signal of the compensation end FEED. Accordingly, when the pixel corresponding to the shift register does not exhibit a display abnormality, the compensation signal of the compensation end FEED may be set to the same as the signal of the input end INPUT, so that in the charging phase, the signal of the pull-up node PU and the signal stored at the first storage capacitor C1 is still the signal of the input end INPUT (that is, the signal of the control end of the second switching element T2 is still the signal of the input end INPUT), ensuring that the newly added compensation circuit 120 does not cause influence on the shift register. When a display abnormality occurs in the pixel corresponding to the shift register, the magnitude of the compensation signal input by the compensation end FEED may be determined according to the specific situation of the display abnormality, so that in the charging phase, the parallel signal of the signal of the input end INPUT and the compensation signal of the compensation end FEED, which is transmitted to the pull-up node PU and stored at the first storage capacitor C1, may be changed, thereby changing the delay time of the signal from the first phase clock signal end CKL passing through the second switching element T2. Correspondingly, the delay time of scanning signals output by the shift register is improved, thereby improving the charging rate of the pixel corresponding to the shift register, ensuring uniformity of displayed brightness of pixels, and eliminating undesirable phenomena such as X-thin dark lines, H-BLOCK, and horizontal stripes.

Embodiment IV

Figure 5:
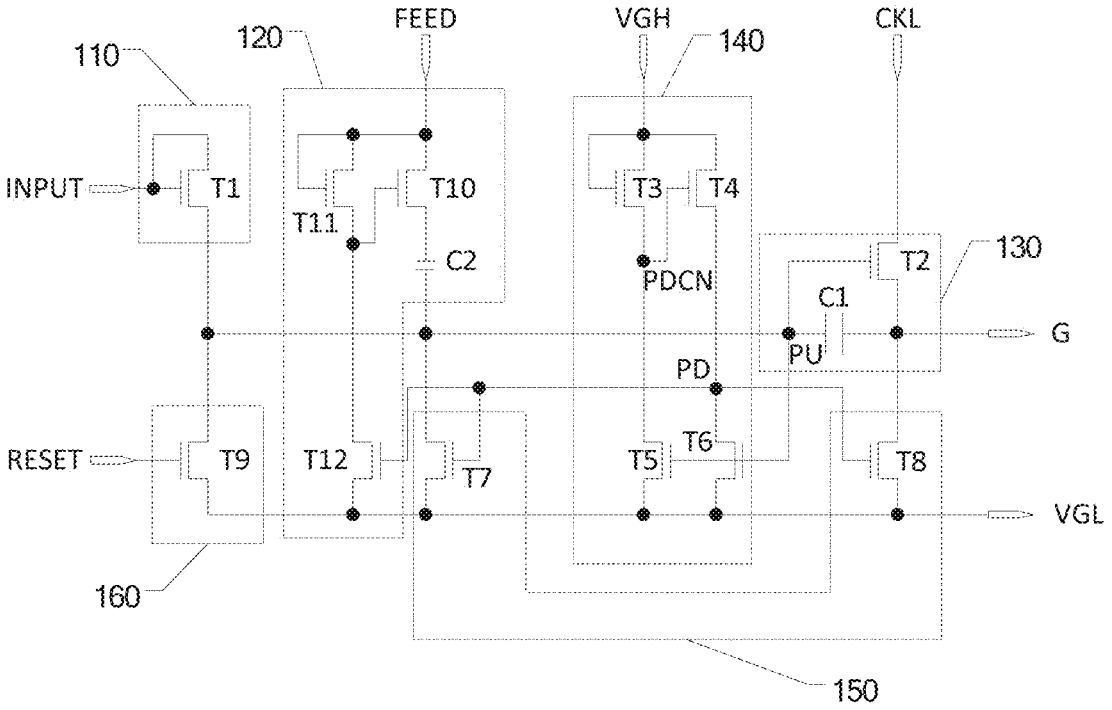
FIG. 5 is a schematic structural diagram IV illustrating a shift register according to an exemplary embodiment of the present disclosure.

As shown in FIG. 5, the shift register may include: an input circuit 110, a compensation circuit 120, an output circuit 130, a pull-down control circuit 140, a pull-down circuit 150, and a reset circuit 160. The compensation circuit 120 is connected to the input circuit 110. The output circuit 130 is connected to the input circuit 110 and the compensation circuit 120. The pull-down control circuit 140 is connected to the input circuit 110. The pull-down circuit 150 is connected between the compensation circuit 120 and the output circuit 130. The reset circuit 160 is connected between the input circuit 110 and the pull-down circuit 150.

The input circuit 110 includes:

a first switching element T1, provided with a control end and a first end connected to an input end INPUT, and a second end connected to the pull-up node PU.

The compensation circuit 120 includes:

a tenth switching element T10, provided with a first end connected to a compensation end FEED;

an eleventh switching element T11, provided with a control end and a first end connected to the compensation end FEED, and a second end connected to a control end of the tenth switching element T10;

a second storage capacitor C2, provided with a first end connected to a second end of the tenth switching element T10, and a second end connected to the pull-up node PU; and a twelfth switching element T12, provided with a control end connected to the pull-down node PD, a first end connected to a second end of the eleventh switching element T11, and a second end connected to the second signal end VGL.

The output circuit 130 includes:

a second switching element T2, provided with a control end connected to the pull-up node PU, a first end connected to the first phase clock signal end CKL, and a second end connected to the output end G; and a first storage capacitor C1, provided with a first end connected to the pull-up node PU, and a second end connected to the output end G.

The pull-down control circuit 140 includes:

a third switching element T3, provided with a control end and a first end connected to the first signal end VGH, and a second end connected to the pull-down control node PDCN;

a fourth switching element T4, provided with a control end connected to the pull-down control node PDCN, a first end connected to the first signal end VGH, and a second end connected to the pull-down node PD;

a fifth switching element T5, provided with a control end connected to the pull-up node PU, a first end connected to the pull-down control node PDCN, and a second end connected to the second signal end VGL; and a sixth switching element T6, provided with a control end connected to the pull-up node PU, a first end connected to the pull-down node PD, and a second end connected to the second signal end VGL.

The pull-down circuit 150 includes:

a seventh switching element T7, provided with a control end connected to the pull-down node PD, a first end connected to the pull-up node PU, and a second end connected to the second signal end VGL; and an eighth switching element T8, provided with a control end connected to the pull-down node PD, a first end connected to the output end G, and a second end connected to the second signal end VGL.

The reset circuit 160 includes:

a ninth switching element T9, provided with a control end connected to the reset end RESET, a first end connected to the pull-up node PU, and a second end connected to the second signal end VGL.

In the exemplary embodiment, the first to twelfth switching elements (T1 to T12) may respectively correspond to a first to twelfth switching transistors, and each of the switching transistors has a control end, a first end and a second end. Specifically, the control end of each switching transistor may be a gate, the first end may be a source, and the second end may be a drain. Alternatively, the control end of each switching transistor may be a gate, and the first end may be a drain, the second end may be a source. In addition, each of the switching transistors may be an enhancement transistor or a depletion transistor, which is not specifically limited in this exemplary embodiment. Moreover, each of the switching transistors may be an N-type transistor or a P-type transistor, which is not specifically limited in this exemplary embodiment.

The operation of the shift register in FIG. 5 will be described below by taking an example in which all switching elements are N-type thin film transistors. Since the switching elements are N-type thin film transistors, on signals of all the switching elements are high level signals, and off signals of all switching elements are low level signals.

In a pixel holding phase, a signal of the reset end RESET, a signal of the input end INPUT, and a signal of the second signal end VGL are all low level signals, and a signal of the first signal end VGH and a signal of the first phase clock signal end CKL are both high level signals. At this time, the third switching element T3 is turned on by the signal of the first signal end VGH, and transmits the signal of the first signal end VGH to the pull-down control node PDCN. The fourth switching element T4 is turned on by the pull-down control node PDCN, and transmits the signal of the first signal end VGH to the pull-down node PD. The seventh switching element T7, the eighth switching element T8 and the twelfth switching element T12 are turned on by the signal of the first signal end VGH and transmitted to the pull-down node PD, and transmit the signal of the second signal end VGL to the pull-up node PU, the output end G and the control end of the tenth switching element T10, so as to continuously perform noise reducing to the pull-up node PU and the output end G through the signal of the second signal end VGL, and turn off the tenth switching element T10. At the same time, the fifth switching element T5, the sixth switching element T6, and the second switching element T2 are turned off by the signal of the second signal end VGL and transmitted to the pull-up node PU, the first switching element T1 is turned off by the signal of the input end INPUT, the ninth switching element T9 is turned off by the signal of the reset end RESET, and the eleventh switching element T11 is turned on by the compensation signal of the compensation end FEED. Since the signal of the second signal end VGL is the low level signal, the scanning signal output by the output end G is low level signal.

In a charging phase, the signal of the input end INPUT and the signal of the first signal end VGH are high level signals, and the signal of the reset end RESET, the signal of the second signal end VGL, and the signal of the first phase clock signal end CKL are all low level signals. At this time, the first switching element T1 is turned on, and the signal of the input end INPUT is transmitted to the pull-up node PU and used for charging the first storage capacitor C1. At the same time, the eleventh switching element is turned on by the compensation signal of the compensation end FEED, and transmits the compensation signal of the compensation end FEED to the control end of the tenth switching element T10, turning on the tenth switching element T10 to transmit the compensation signal of the compensation end FEED to the first end of the second storage capacitor C2. Accordingly, the signal of the input end INPUT and the compensation signal of the compensation end FEED are used for charging the second storage capacitor C2. The fifth switching element T5 and the sixth switching element T6 are turned on by the signal of the pull-up node PU, transmit the signal of the second signal end VGL to the pull-down node PD and the pull-down control node PDCN. The seventh switching element T7, the eighth switching element T8, and the twelfth switching element T12 are turned off by the signal of the second signal end VGL and transmitted to the pull-down node PD. The second switching element T2 is turned on by the signal of the pull-up node PU, and transmits the signal of the first phase clock signal end CKL to the output end G. Since the signal of the first phase clock signal end CKL is the low level signal, the scanning signal output by the output end G is the low level signal.

In a bootstrap phase, the signal of the first signal end VGH and the signal of the first phase clock signal end CKL are high level signals, the signal of the reset end RESET, the signal of the second signal end VGL, and the signal of the input end INPUT are low level signals. If the compensation signal of the compensation end FEED remains the same as in the charging phase, that is, remains unchanged, the second switching element T2 is turned on under the action of the first storage capacitor C1, that is, the second switching element T2 is turned on by the signal of the input end INPUT, which is stored at the first storage capacitor C1 in the charging phase. The signal of the first phase clock signal end CKL is transmitted to the output end G. Since the signal of the first phase clock signal end CKL is the high level signal, the scanning signal output by the output end G is the high level signal. In addition, due to the bootstrap action of the first storage capacitor C1, a potential of the pull-up node PU is bootstrapped from the signal of the input end INPUT to a sum of the signal of the input end INPUT and the signal of the first phase clock signal end CKL. If the compensation signal of the compensation end FEED is different from that in the charging phase, that is, is changed, due to the bootstrap action of the second storage capacitor C2, the changing amount of the compensation signal of the compensation end FEED is bootstrapped to the pull-up node PU. Accordingly, the signal of the pull-up node PU becomes a sum of the signal of the input end INPUT and the changing amount of the compensation signal of the compensation end FEED. At this time, the second switching element T2 is turned on under the action of the sum of the signal of the input end INPUT and the changing amount of the compensation signal of the compensation end FEED, and transmits the signal of the first phase clock signal end CKL to the output end G. Since the signal of the first phase clock signal end CKL is the high level signal, the scanning signal output by the output end G is the high level signal. In addition, due to the bootstrap action of the first storage capacitor C1, the potential of the pull-up node PU is bootstrapped from a sum of the signal of the input end INPUT and the changing amount of the compensation signal of the compensation end FEED to the sum of the signal bootstrapped to the input end INPUT, the changing amount of the compensation signal of the compensation end FEED, and the signal of the first phase clock signal end CKL.

In a reset phase, the signal of the reset end RESET and the signal of the first signal end VGH are high level signals, the signal of the second signal end VGL, the signal of the input end INPUT, and the signal of the first phase clock signal end CKL are all low level signals. The ninth switching element T9 is turned on by the signal of the reset end RESET, and transmits the signal of the second signal end VGL to the pull-up node PU, thereby resetting the pull-up node PU. As the signal of the pull-up node PU is low level signal at this time, the fifth switching element T5 and the sixth switching element T6 are turned off. The third switching element T3 and the fourth switching element T4 are turned on by the signal of the first signal end VGH, and the signal of the first signal end VGH is transmitted to the pull-down node PD. The seventh switching element T7, the eighth switching element T8 and the twelfth switching element T12 are turned on by the signal of the first signal end VGH, and the signal of the second signal end VGL is transmitted to the pull-up node PU, the output end G and the control end of the tenth switching element T10. Accordingly, the scanning signal output by the output end G is low level signal.

Since the relationship between the signal of the gate (i.e., the control end) of the switching element and the charging rate of the pixel has been described above, it will not be described herein.

Based on the above principle, during the operation process of the above shift register, when the pixel corresponding to the shift register does not exhibit a display abnormality, the compensation signal of the compensation end FEED may be set to the same as the signal of the input end INPUT and remains unchanged, so that in the charging phase, the signal of the pull-up node PU is the sum of the signal of the input end INPUT and the signal of the first phase clock signal end CKL, ensuring that the newly added compensation circuit 120 does not cause influence on the shift register. When a display abnormality occurs in the pixel corresponding to the shift register, the changing amount of the compensation signal input by the compensation end FEED may be determined in the bootstrap phase according to the specific situation of the display abnormality, and the magnitude of the compensation signal input by the compensation end FEED may be varied based on the changing amount, so as to bootstrap the changing amount to the pull-up node through the second storage capacitor, causing the signal of the pull-up node PU to become the sum of the signal of the input end INPUT and the changing amount of the compensation signal of the compensation end FEED. In this way, the signal of the pull-up node PU is changed, thereby changing the delay time of the signal from the first phase clock signal end CKL passing through the second switching element T2. Correspondingly, the delay time of scanning signals output by the shift register is improved, thereby improving the charging rate of the pixel corresponding to the shift register, ensuring uniformity of displayed brightness of pixels, and eliminating undesirable phenomena such as X-thin dark lines, H-BLOCK, and horizontal stripes.

It should be noted that, in the embodiment IV, regardless of the specific value of the compensation signal of the compensation terminal FEED or how much it will be changed, the value must be sufficient to turn on the eleventh switching element.

It should be noted that, in the above embodiments, all the switching elements are N-type thin film transistors. However, those skilled in the art can easily obtain shift registers in which all switching elements are P-type thin film transistors according to the shift register provided by the present disclosure. When all switching elements are P-type thin film transistors, the on-signal of all switching elements are at low level. The use of P-type thin film transistor has the following advantages. For example, noise suppression is strong; it is low level conduction and low level is easy to be implemented in charge management; P-type thin film transistor is simple in process and relatively low in price; P-type thin film transistors have better stability; and the like.

In other embodiments, the shift register provided by the present disclosure may also be changed to a CMOS (Complementary Metal Oxide Semiconductor) circuit or the like, and is not limited to the shift register provided in this embodiment, and details are not described herein again.

In summary, the charging rate of the pixels corresponding to the shift register can be adjusted by adjusting the signal of the pull-up node in the shift register. Specifically, for bright lines, when the switching elements in the shift register are all N-type transistors, the delay time of the scanning signal may be increased by lowering the signal of the pull-up node in the shift register, thereby reducing charging rate of the corresponding pixels to reduce brightness of the pixels to eliminate the bright lines. For the dark lines, the signal of the pull-up node in the shift register may be increased to reduce the delay time of the scanning signal, thereby increasing the charging rate of the corresponding pixels, so as to enhance the brightness of the pixels and eliminate dark lines. It should be noted that, for the shift register in which the switching elements are all P-type transistors, the adjustment principle is the same as the adjustment principle of the shift register in which the switching elements are all N-type transistors, and therefore will not be described herein.

Figure 6:
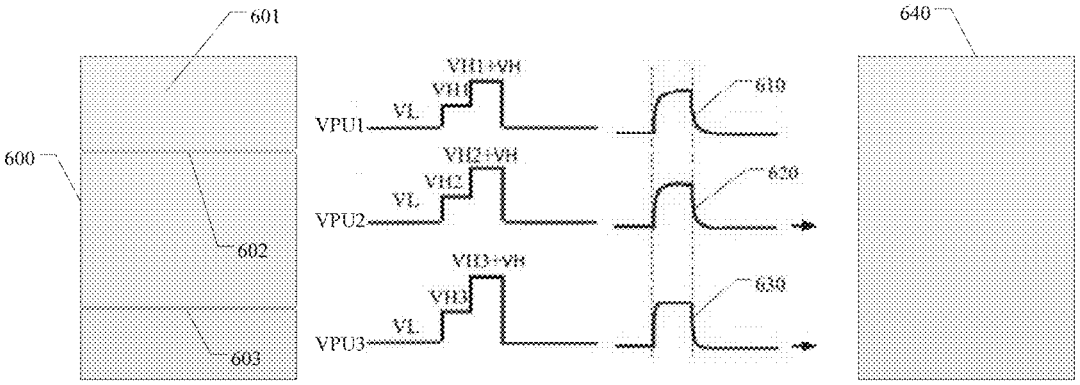
FIG. 6 is a schematic diagram illustrating compensation for X-thin dark line according to an exemplary embodiment of the present disclosure.

A schematic diagram of compensation for the X-thin dark line is shown in FIG. 6. The display panel 600 before compensation in FIG. 6 has three regions, including: a normal region 601, a first dark line 602, and a second dark line 603, wherein the second dark line 603 has a lower brightness than the first dark line 602. Hereinafter, a process of eliminating dark lines will be described by taking an example in which the switching elements in the shift register corresponding to the pixels in the display panel are all N-type transistors. It should be noted that the high level of the signal of the first phase clock signal end is VH. For the first dark line 602, the signal of the pull-up node VPU2 in the shift register corresponding to the pixels in the first dark line 602 may be set to VH2 through the compensation end in the charging phase, and VH2 is larger than the signal VH1 of the pull-up node VPU1 in the shift register corresponding to the pixels in the normal region 601 in the charging phase. At the same time, in the bootstrap phase, the signal of the pull-up node VPU2 in the shift register corresponding to the pixels in the first dark line 602 is VH2+VH under the bootstrap action of the signal at the first phase clock signal end, so as to reduce the delay time of the scanning signal 620 output by the shift register corresponding to the pixels in the first dark line 602, thereby improving the charging rate of the pixels in the first dark line 602, and improving the brightness of the first dark line 602 to eliminate the first dark line 602. For the second dark line 603, the signal of the pull-up node VPU3 in the shift register corresponding to the pixels in the second dark line 603 may be set to VH3 through the compensation end in the charging phase, and VH3 is larger than the signal VH2 of the pull-up node VPU2 in the shift register corresponding to the pixels in the first dark line 602 in the charging phase. At the same time, in the bootstrap phase, the signal of the pull-up node VPU3 in the shift register corresponding to the pixels in the second dark line 603 is bootstrapped to VH3+VH under the action of the signal of the first phase clock signal, so as to reduce the delay time of the scanning signal 630 output by the shift register corresponding to the pixels in the second dark line 603, improve the charging rate of the pixels in the second dark line 603, thereby improving the brightness of the second dark line 603 to eliminate the second dark line 603. As can be seen from the display panel 640 after compensation, based on the above manner, the first dark line 602 and the second dark line 603 in the display panel 600 before compensation have been completely eliminated.

Figure 7:
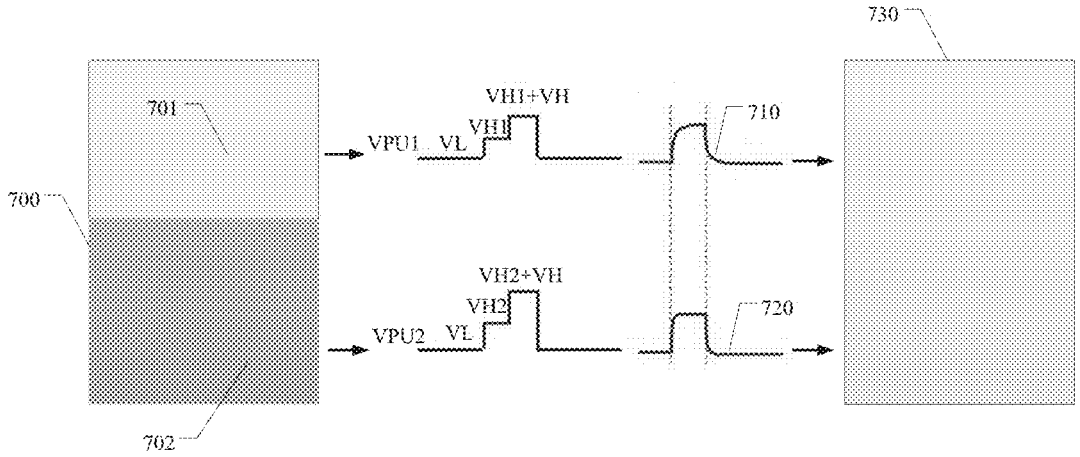
FIG. 7 is a schematic diagram illustrating compensation for H-BLOCK according to an exemplary embodiment of the present disclosure.

A schematic diagram of compensation for the H-BLOCK is shown in FIG. 7. The phenomenon of poor H-Block refers to a difference in brightness displayed in different display regions. The display panel 700 before compensation in FIG. 7 has two regions, namely, a bright region 701 and a dark region 702. Hereinafter, a process of eliminating the H-BLOCK will be described by taking an example in which the switching elements in the shift register corresponding to the pixels in the display panel are all N-type transistors. It should be noted that the high level of the signal of the first phase clock signal end is VH. For the bright region 701, the signal of the pull-up node VPU1 in the shift register corresponding to the pixels in the bright region 701 may be lowered to VH1 by the compensation end in the charging phase, so as to increase the delay time of the scanning signal 710 output by the shift register corresponding to the pixels in the bright region 701, thereby reducing the charging rate of the pixels in the bright region 701 and reducing the brightness of the bright region 701. For the dark region 702, the signal of the pull-up node VPU2 in the shift register corresponding to the pixels in the dark region 702 may be raised to VH2 through the compensation end in the charging phase, so as to reduce the delay time of the scanning signal 720 output by the shift register corresponding to the pixels in the dark region 702, thereby increasing the charging rate of the pixels in the dark region 702 and increasing the brightness of the dark region 702, and further eliminating the H-Block failure. As can be seen from the display panel 730 after compensation, based on the above manner, the H-Block failure in the display panel 700 before compensation has been completely eliminated.

According to embodiments of the disclosure, there is provided a shift register circuit. The shift register circuit may include N cascading (i.e., N stages of) shift registers according to the embodiments described above. Herein, the second signal ends of the shift registers at respective stages are provided signals according to display states of pixels corresponding to the shift registers at respective stages.

Figure 8:
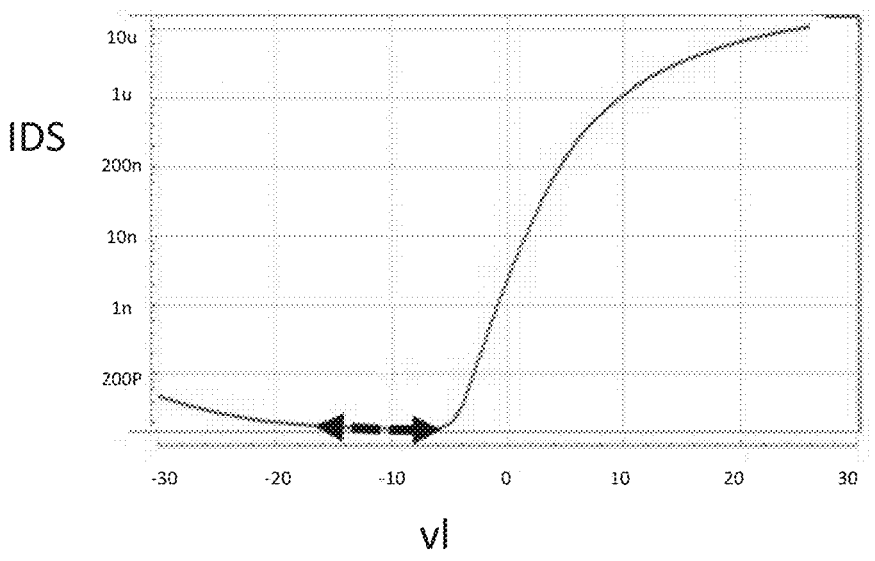
FIG. 8 is a schematic diagram illustrating a relationship between a leakage current of a switching element and a turn-off signal in scanning signals output from a shift register according to an exemplary embodiment.

In the present exemplary embodiment, as shown in FIG. 8, taking an example in which the switching elements in the pixel are N-type transistors, a relationship between the drain current IDS of the switching element in the pixel and the turn-off signal VL (i.e., low level signal) in the scanning signal output by the shift register is as follow. When the turn-off signal VL (i.e., low level signal) in the scanning signal is −8V, the drain current IDS of the switching element is the smallest. When the turn-off signal VL in the scanning signal (i.e., low level signal) is increased or decreased on the basis of −8V, the drain current IDS of the switching element is increased. Therefore, when the turn-off signal VL in the scanning signal is at a reference value (for example, −8V as described above), the drain current of the switching element is the smallest, and when the turn-off signal VL in the scanning signal is increased or decreased based on the reference value, the drain current IDS of the switching element is increased. Further, since the amount of change in the holding voltage of the pixel is positively correlated with the drain current IDS of the switching element in the pixel during the pixel holding phase, that is, the larger the drain current IDS of the switching element in the pixel, the larger the amount of change in the holding voltage of the pixel. It can be seen from the above that when the turn-off signal VL in the scanning signal is at the reference value, the amount of change in the holding voltage of the pixel is the smallest, and when the turn-off signal VL in the scanning signal is increased or decreased on the basis of the reference value, the amount of change in the holding voltage of the pixel is increased.

Moreover, since the holding voltage of each pixel can be changed by changing the amount of change of the holding voltage of each pixel in the holding phase of the pixel, the difference in the charging rate of the pixel may be compensated to ensure uniformity of display brightness of the pixels, thereby eliminating X-thin dark line, H-BLOCK, horizontal stripes and other undesirable phenomena.

Therefore, in summary, the amount of change in the holding voltage corresponding to each pixel in the holding phase can be changed by adjusting the turn-off signal in the scanning signal corresponding to each pixel, and the holding voltage of each pixel may be changed according to the amount of change in the holding voltage of each pixel and, further, compensates for the difference in the charging rate of the pixels, ensuring the uniformity of display brightness of the pixels, thereby eliminating X-thin dark lines, H-BLOCK, horizontal stripes and the like.

Based on the above principle, since the signals of the second signal ends of the shift registers at respective stages are the turn-off signals in the scanning signals output therefrom, in the present exemplary embodiment, the signals of the second signal ends of the shift registers at respective stages are respectively determined according to the display states of respective pixels corresponding thereto, and input to the second signal ends of the shift registers at respective stages, so as to vary the amount of change of the holding voltage of each pixel in the holding phase based on the signal, change the holding voltage of each pixel to compensate for the difference in the charging rate of pixels, thereby ensuring the uniformity of display brightness of the pixels, and eliminating X-thin dark lines, H-BLOCK, horizontal stripes and the like.

Figure 9:
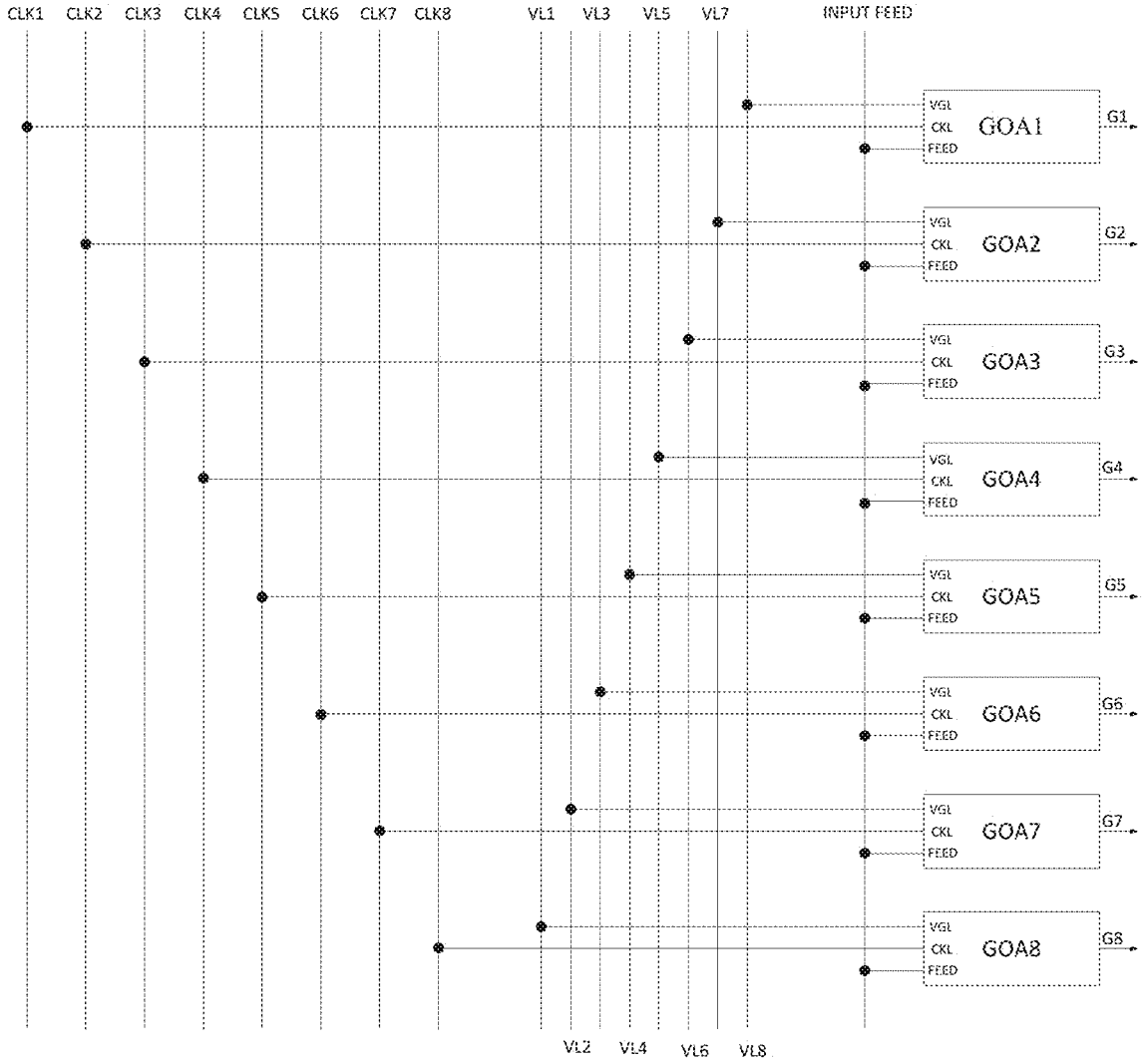
FIG. 9 is a schematic diagram I illustrating a shift register circuit according to an exemplary embodiment of the present disclosure.

For example, FIG. 9 shows a shift register circuit including eight cascaded shift registers. As can be seen from the figure, the second signal ends VGL of the first stage shift register to the eighth stage gate drive circuit GOA1-GOA8 are sequentially configured to receive the eighth signal to the first signal VL8-VL1. When there is abnormality in pixel display, the signal of the second signal end VGL of the shift register GOA corresponding thereto may be adjusted to change the holding voltage of the pixel, thereby eliminating the display abnormality.

Figure 10:
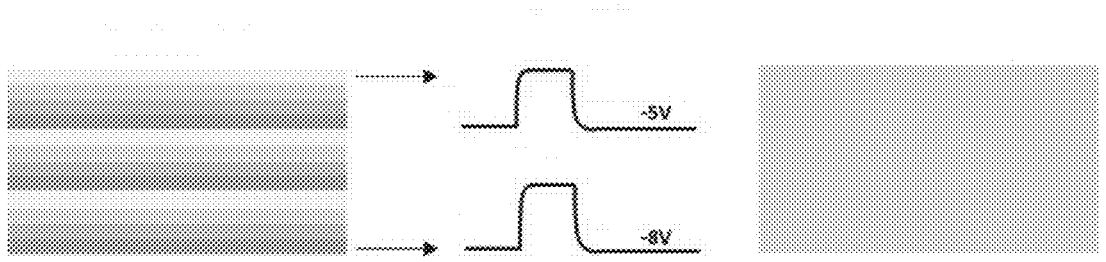
FIG. 10 is a schematic diagram illustrating compensation for horizontal stripes according to an exemplary embodiment of the present disclosure.

A schematic diagram of compensating for horizontal stripes is shown in FIG. 10. Taking an example in which the switching elements in the pixels are N-type transistors, the signal of the second signal end in the shift register corresponding to the pixels in a bright line is raised (for example, set to −5V), so as to increase the drain current of the switching element in the pixels in the bright line, thereby increasing the amount of change in the holding voltage of the pixels in the bright line, reducing the holding voltage of the pixels in the bright line. At the same time, the signal of the second signal ends in the shift register corresponding to the pixels in a dark line is set as the reference value (for example, set to −8V), the drain current of the switching elements in the pixels in the dark line is minimized, so that the amount of change in the holding voltage of the pixels in the dark line is minimized. Accordingly, each pixel has a different holding voltage, thereby compensating the difference in charging rate of pixels to eliminate horizontal stripes.

The pull-down circuit of the shift register may include a first pull-down circuit and a second pull-down circuit, and the second signal end may include a first sub-signal end and a second sub-signal end. In an embodiment, the first pull-down circuit is connected to the pull-down node, the output end, and the first sub-signal end, and is configured to transmit a signal of the first sub-signal end to the output end in response to a signal of the pull-down node; the second pull-down circuit is connected to the pull-down node, the pull-up node, and the second sub-signal end, and is configured to transmit a signal of the second sub-signal end to the pull-up node in response to a signal of the pull-down node; the reset circuit of the shift register is connected to the reset end, the pull-up node, and the second sub-signal end, and is configured to transmit a signal of the second sub-signal end to the pull-up node in response to a signal of the reset end.

Figure 11:
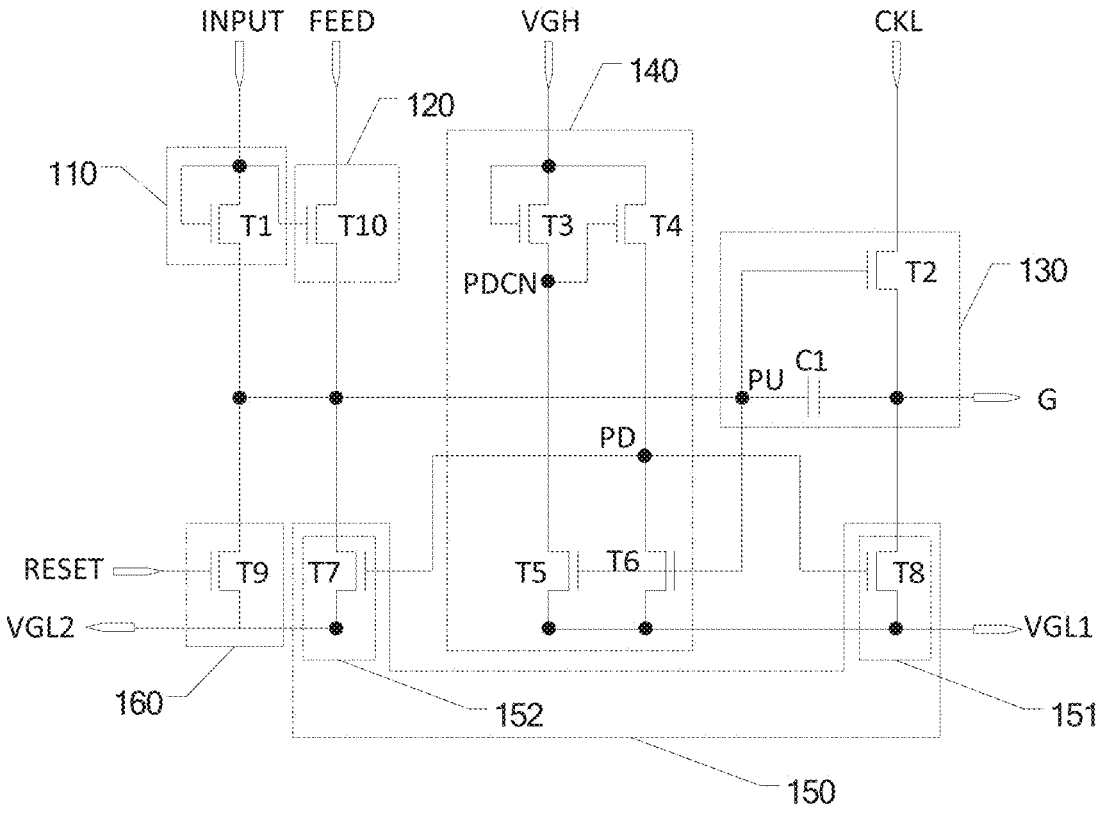
FIG. 11 is a schematic structural diagram V illustrating a shift register according to an exemplary embodiment of the present disclosure.

FIG. 11 illustrates a shift register provided with a pull-down circuit including a first pull-down circuit and a second pull-down circuit. As can be seen from the figure, the pull-down circuit 150 includes a first pull-down circuit 151 and a second pull-down circuit 152. The first pull-down circuit 151 includes: an eighth switching element, provided with a control end connected to the pull-down node PD, a first end connected to the output end G, and a second end connected to the first sub-signal end VGL1, and being configured to transmit a signal of the first sub-signal end VGL1 to the output end G in response to the signal of the pull-down node PD. The second pull-down circuit 152 includes: a seventh switching element, provided with a control end connected to the pull-down node PD, a first end connected to the pull-up node PU, and a second end connected to the second signal end VGL2, and being configured to transmit a signal of the second sub-signal end VGL2 to the pull-up node PU in response to the signal of the pull-down node PD. The reset circuit 160 of the shift register is connected to the reset end RESET, the pull-up node PU, and the second sub-signal end VGL2, and being configured to transmit the signal of the second sub-signal end VGL2 to the pull-up node PU in response to a signal of the reset end node RESET.

Based on the shift register including the first pull-down circuit and the second pull-down circuit, and the second signal end including the first sub-signal end and the second sub-signal end, there are provided two following manners for providing signals to the second signal ends of the shift registers at each stage according to display states of pixels corresponding to the shift registers at each stage.

In the first manner, the signals of the first sub-signal end may include a first signal to an N-th signal. On the basis of the above, the manner for providing signals to the second signal ends of the shift registers at each stage according to display states of pixels corresponding to the shift registers at each stage is described as follows. According to a cascade relationship of the shift registers, the first sub-signal ends of the shift registers at the first stage to the N-th stage sequentially receives the N-th signal to the first signal; and according to the cascade relationship of the shift registers, the second sub-signal ends of the shift registers at the first stage to the N-th stage receives the first signal.

In the present exemplary embodiment, the specific values of the first signal to the N-th signal may be set according to the display state of corresponding pixels. According to the above connection manner, a voltage difference between the control end and the second end of the switching element in the off state (such as the second switching element T2 in FIG. 11) connected to the pull-up node in the N-th stage shift register is the difference between the signal of the second sub-signal end and the signal of the first sub-signal end. Taking an example in which the switching elements are N-type transistors, when the first signal to the N-th signal are gradually increased, the voltage difference between the control end and the second end of the switching element in the off state (such as the second switching element T2 in FIG. 11) connected to the pull-up node in the N-th stage shift register to the first stage shift register all have a negative value, the voltage difference between the control end and the second end of the switching element in the off state (such as the second switching element T2 in FIG. 11) connected to the pull-up node is gradually decreased from the N-th stage shift register to the first stage shift register, the drain current of the switching element in the off state (such as the second switching element T2 in FIG. 11) connected to the pull-up node is gradually increased from the N-th stage shift register to the first stage shift register, but is still smaller than the drain current of the switching element (such as the second switching element T2 in FIG. 11) connected to the pull-up node when the first sub-signal end and the second sub-signal end are input with the same signal.

By inputting different signals to the first sub-signal end and the second sub-signal end, a problem, that the transfer characteristic of the switching element is shifted to the left, can be improved compared to inputting the same signal to the first sub-signal end and the second sub-signal end, the switching element being provided in the shift register and connected to the pull-up node. Accordingly, the influence of the switching element connected to the pull-up node on the turn-off signal in the scanning signal outputted by the shift register can be reduced, thereby increasing the accuracy for improving displaying anomalies by adjusting the turn-off signal in the scanning signal.

Figure 12:
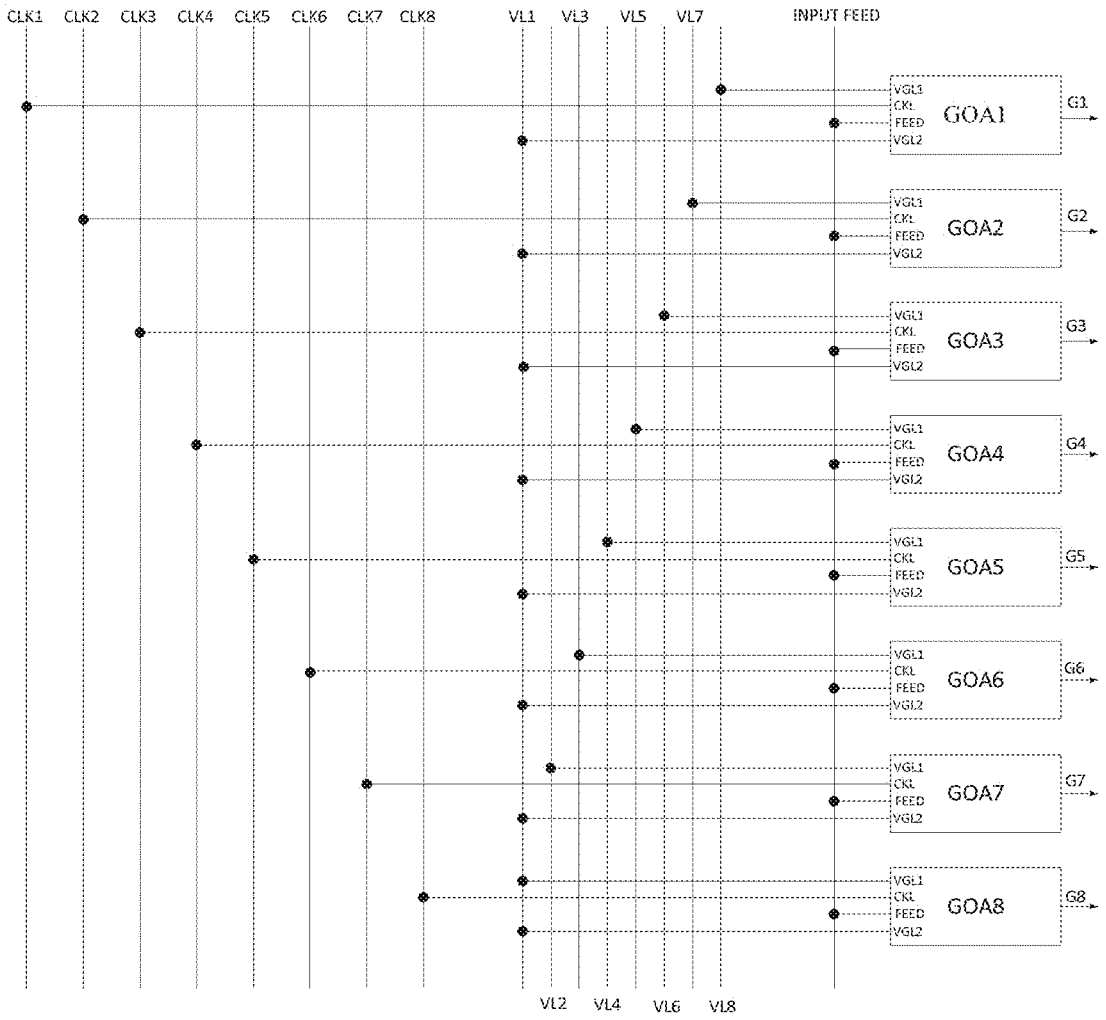
FIG. 12 is a schematic structural diagram II illustrating a shift register circuit according to an exemplary embodiment of the present disclosure.

FIG. 12 shows a shift register circuit including eight cascaded shift registers, wherein the pull-down circuit of the shift register includes a first pull-down circuit and a second pull-down circuit. As can be seen from the figure, the first sub-signal ends VGL1 of the first stage shift register to the eighth shift register GOA1-GOA8 are sequentially configured to receive the eighth signal to the first signal VL8-VL1; the second sub-signal ends VGL2 of the first stage shift register to the eighth shift register GOA1-GOA8 are all configured to receive the first signal VL1.

In the second manner, the signals of the first sub-signal end may include a first signal to an (N+1)-th signal. On the basis of the above, the manner for providing signals to the second signal ends of the shift registers at each stage according to display states of pixels corresponding to the shift registers at each stage is described as follows. According to a cascade relationship of the shift register, the first sub-signal ends of the shift registers at a first stage to an N-th stage sequentially receive the (N+1)-th signal to a second signal; and according to the cascade relationship of the shift registers, the second sub-signal ends of the shift registers at the first stage to the N-th stage sequentially receive the N-th signal to the first signal.

In the present exemplary embodiment, the specific values of the first signal to the (N+1)-th signal may be set according to the display state of corresponding pixels. According to the above connection manner, a voltage difference between the control end and the second end of the switching element in the off state (such as the second switching element T2 in FIG. 11) connected to the pull-up node in the N-th stage shift register is the difference between the signal of the second sub-signal end and the signal of the first sub-signal end. Taking an example in which the switching elements are N-type transistors, when the first signal to the (N+1)-th signal are gradually increased with the same difference value between any two neighboring signals, the voltage difference between the control end and the second end of the switching element in the off state (such as the second switching element T2 in FIG. 11) connected to the pull-up node in the N-th stage shift register to the first stage shift register all have a negative value, the voltage difference between the control end and the second end of the switching element in the off state (such as the second switching element T2 in FIG. 11) connected to the pull-up node is all the same from the N-th stage shift register to the first stage shift register, the drain current of the switching element in the off state (such as the second switching element T2 in FIG. 11) connected to the pull-up node is all the same from the N-th stage shift register to the first stage shift register, but is still smaller than the drain current of the switching element (such as the second switching element T2 in FIG. 11) connected to the pull-up node when the first sub-signal end and the second sub-signal end are input with the same signal.

By inputting stepped and regular signals to the first sub-signal end and the second sub-signal end in the shift register at respective stages, the influence of the switching element connected to the pull-up node on the turn-off signal in the scanning signal outputted by the shift register can be eliminated compared to inputting the same signal to the first sub-signal end and the second sub-signal end. Accordingly, the control capability of the shift register circuit is improved and brightness variation of pixels depending on the turn-off signal in the scanning signals is simplified, thereby increasing the accuracy for improving displaying anomalies by adjusting the turn-off signal in the scanning signal.

Figure 13:
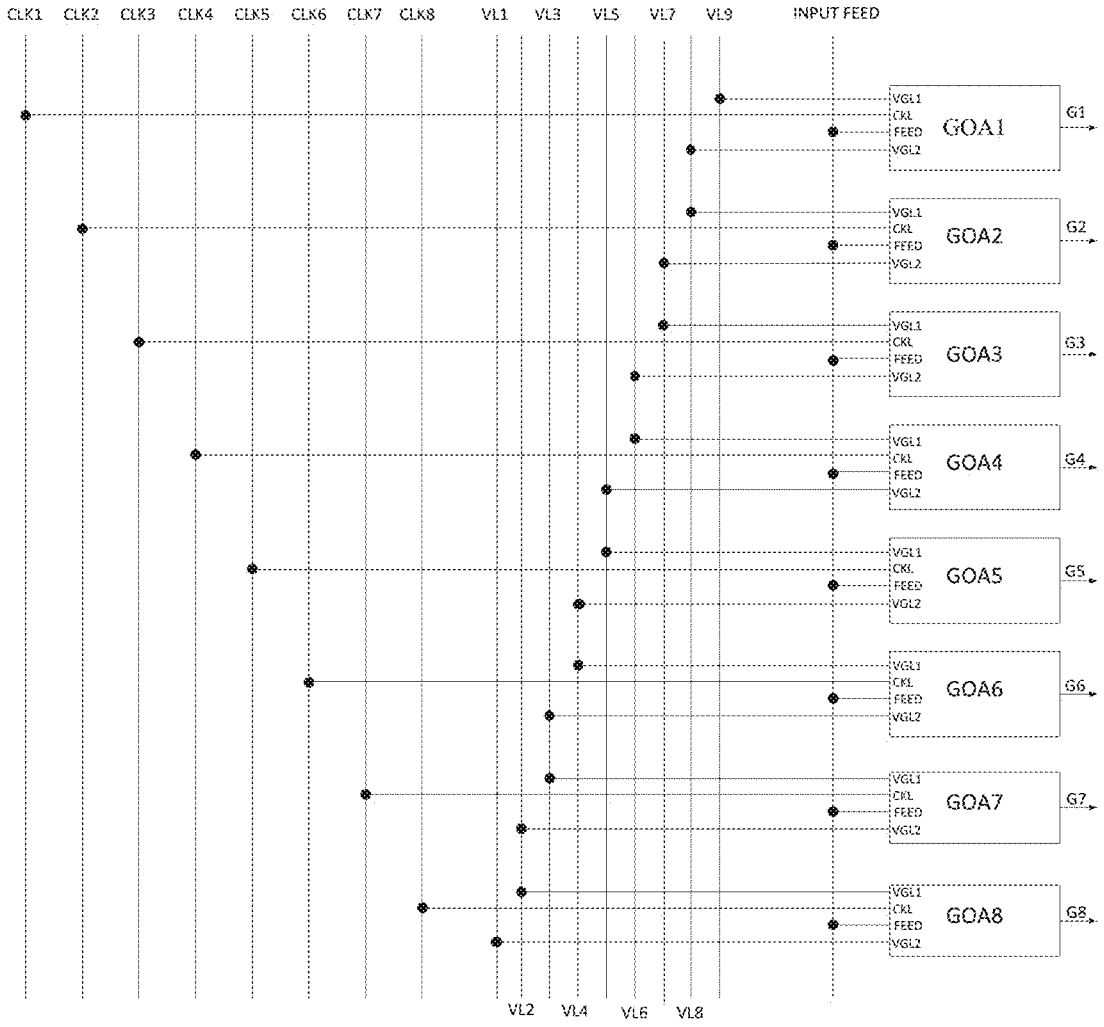
FIG. 13 is a schematic structural diagram III illustrating a shift register circuit according to an exemplary embodiment of the present disclosure.

FIG. 13 shows a shift register circuit including eight cascaded shift registers, wherein the pull-down circuit of the shift register includes a first pull-down circuit and a second pull-down circuit. As can be seen from the figure, the first sub-signal ends VGL1 of the first stage shift register to the eighth shift register GOA1-GOA8 are sequentially configured to receive the ninth signal to the second signal VL9-VL2; the second sub-signal ends VGL2 of the first stage shift register to the eighth shift register GOA1-GOA8 are sequentially configured to receive the eighth signal to the first signal VL8-VL1.

According to one or more embodiments of the disclosure as described above, the shift register circuit includes N cascading shift registers described above, and the second signal ends of the shift registers at respective stages are provided signals according to display states of pixels corresponding to the shift registers at respective stages. During operation of the shift register circuit, if pixels corresponding to a certain stage or some stages of shift registers have display abnormality, differentiated signals may be respectively supplied to the second signal ends of the corresponding shift registers according to the display abnormality of each pixel, so as to respectively change holding voltage of each corresponding pixel, thereby compensating for the difference in the charging rate of the corresponding pixels, ensuring uniformity of display brightness of the pixels, and eliminating undesirable phenomena such as X-thin dark lines, H-BLOCK, and horizontal stripes.

The present exemplary embodiment also proposes a display device which may include the above shift register circuit provided with the above shift registers. In the present exemplary embodiment, the display device includes a display area and a peripheral area. The peripheral area of the display device may be provided with the above-described shift register circuit, and the shift register circuit includes at least one of the above shift registers. Based on this, the display area of the display device may include a plurality of gate lines and a plurality of data lines staggered horizontally and vertically, and a plurality of pixels defined by the adjacent gate lines and the adjacent data lines. In an embodiment, the gate lines are configured to transmit scanning signals provided by the shift register circuit, and the data lines are configured to transmit data signals provided by a source driver. The display device may include, for example, a mobile phone, a tablet computer, a television, a notebook computer, a digital photo frame, a navigator, or any product or component having a display function.

It should be noted that although circuits or units of devices for executing functions are described above, such division is not mandatory. In fact, features and functions of two or more of the circuits or units described above may be embodied in one circuit or unit in accordance with the embodiments of the present disclosure. Alternatively, the features and functions of one circuit or unit described above may be further divided into multiple circuits or units.

In addition, although the various steps of the method of the present disclosure are described in a particular order in the figures, this is not required or implied that the steps must be performed in the specific order, or all the steps shown must be performed to achieve the desired result. Additionally or alternatively, certain steps may be omitted, multiple steps may be combined into one step, and/or one step may be decomposed into multiple steps and so on.

Other embodiments of the present disclosure will be apparent to those skilled in the art. The present application is intended to cover any variations, uses, or adaptations of the present disclosure, which are in accordance with the general principles of the present disclosure and include common general knowledge or conventional technical means in the art that are not disclosed in the present disclosure. The specification and embodiments are illustrative, and the real scope and spirit of the present disclosure is defined by the appended claims.

What is claimed is:

1. A shift register, comprising:

an input circuit connected to a pull-up node and configured to provide a signal to the pull-up node;

a compensation circuit connected to the pull-up node and configured to transmit a compensation signal to the pull-up node, the compensation circuit being connected to the input circuit;

an output circuit connected to the pull-up node, an output end, and a first phase clock signal end, and configured to transmit a signal of the first phase clock signal end to the output end in response to a signal of the pull-up node, the output circuit being connected to the input circuit and the compensation circuit;

a pull-down control circuit connected to a first signal end, a pull-down control node, a pull-down node, the pull-up node, and a second signal end, and configured to transmit a signal of the second signal end to the pull-down node and the pull-down control node in response to the signal of the pull-up node, and transmit a signal of the first signal end to the pull-down control node and the pull-down node in response to the signal of the first signal end, the pull-down control circuit being connected to the input circuit;

a pull-down circuit connected to the pull-up node, the pull-down node, the output end and the second signal end, and configured to transmit the signal of the second signal end to the pull-up node and the output end in response to a signal of the pull-down node, the pull-down circuit being connected between the compensation circuit and the output circuit; and a reset circuit connected to a reset end, the second signal end, and the pull-up node, and configured to transmit the signal of the second signal end to the pull-up node in response to a signal of the reset end, the reset circuit being connected between the input circuit and the pull-down circuit;

wherein the input circuit and the compensation circuit comprise any one of the following circuits:

Circuit I: the input circuit comprises: a first switching element provided with a control end connected to an input end, a first end connected to the first signal end, and a second end connected to the pull-up node; and the compensation circuit comprises: a tenth switching element provided with a control end connected to the input end, a first end connected to a compensation end, and a second end connected to the pull-up node;

Circuit II: the input circuit comprises: a first switching element provided with a control end, a first end connected to an input end, and a second end connected to the pull-up node; and the compensation circuit comprises: a tenth switching element provided with a first end connected to a compensation end and a second end connected to the pull-up node; an eleventh switching element provided with a control end, a first end connected to a second phase clock signal end, and a second end connected to a control end of the tenth switching element; and a twelfth switching element provided with a control end connected to the pull-down node, a first end connected to the second end of the eleventh switching element, and a second end connected to the second signal end; and Circuit III: the input circuit comprises: a first switching element provided with a control end, a first end connected to an input end, and a second end connected to the pull-up node; and the compensation circuit comprises: a tenth switching element provided with a first end connected to a compensation end; an eleventh switching element provided with a control end, a first end and a second end, wherein the control end and the first end are directly connected to the compensation end, and the second end is connected to a control end of the tenth switching element; a second storage capacitor provided with a first end and a second end, wherein the first end is directly connected to a second end of the tenth switching element, and the second end is connected to the pull-up node; and a twelfth switching element provided with a control end connected to the pull-down node, a first end connected to a second end of the eleventh switching element, and a second end connected to the second signal end.

2. The shift register according to claim 1, wherein:

the output circuit comprises:

a second switching element provided with a control end connected to the pull-up node, a first end connected to the first phase clock signal end, and a second end connected to the output end; and a first storage capacitor provided with a first end connected to the pull-up node, and a second end connected to the output end;

the pull-down control circuit comprises:

a third switching element provided with a control end and a first end connected to the first signal end, and a second end connected to the pull-down control node;

a fourth switching element provided with a control end connected to the pull-down control node, a first end connected to the first signal end, and a second end connected to the pull-down node;

a fifth switching element provided with a control end connected to the pull-up node, a first end connected to the pull-down control node, and a second end connected to the second signal end; and a sixth switching element provided with a control end connected to the pull-up node, a first end connected to the pull-down node, and a second end connected to the second signal end;

the pull-down circuit comprises:

a seventh switching element provided with a control end connected to the pull-down node, a first end connected to the pull-up node, and a second end connected to the second signal end; and an eighth switching element provided with a control end connected to the pull-down node, a first end connected to the output end, and a second end connected to the second signal end; and the reset circuit comprises: a ninth switching element provided with a control end connected to the reset end, a first end connected to the pull-up node, and a second end connected to the second signal end.

3. The shift register according to claim 1, wherein:

the pull-down circuit comprises a first pull-down circuit and a second pull-down circuit, the second signal end comprises a first sub-signal end and a second sub-signal end;

the first pull-down circuit comprises: an eighth switching element, provided with a control end connected to the pull-down node, a first end connected to the output end, and a second end connected to the first sub-signal end, and configured to transmit a signal of the first sub-signal end to the output end in response to the signal of the pull-down node;

the second pull-down circuit comprises: a seventh switching element, provided with a control end connected to the pull-down node, a first end connected to the pull-up node, and a second end connected to the second sub-signal end, and configured to transmit a signal of the second sub-signal end to the pull-up node in response to the signal of the pull-down node; and the reset circuit is connected to the reset end, the pull-up node, and the second sub-signal end, and configured to transmit the signal of the second sub-signal end to the pull-up node in response to a signal of the reset end.

4. A shift register circuit, comprising:

N cascading shift registers, wherein N is an integer greater than one and any one of the N cascading shift registers comprises:

an input circuit connected to a pull-up node and configured to provide a signal to the pull-up node;

a compensation circuit connected to the pull-up node and configured to transmit a compensation signal to the pull-up node, the compensation circuit being connected to the input circuit;

an output circuit connected to the pull-up node, an output end, and a first phase clock signal end, and configured to transmit a signal of the first phase clock signal end to the output end in response to a signal of the pull-up node, the output circuit being connected to the input circuit and the compensation circuit;

a pull-down control circuit connected to a first signal end, a pull-down control node, a pull-down node, the pull-up node, and a second signal end, and configured to transmit a signal of the second signal end to the pull-down node and the pull-down control node in response to the signal of the pull-up node, and transmit a signal of the first signal end to the pull-down control node and the pull-down node in response to the signal of the first signal end, the pull-down control circuit being connected to the input circuit;

a pull-down circuit connected to the pull-up node, the pull-down node, the output end, and the second signal end, and configured to transmit the signal of the second signal end to the pull-up node and the output end in response to a signal of the pull-down node, the pull-down circuit being connected between the compensation circuit and the output circuit; and a reset circuit connected to a reset end, the second signal end, and the pull-up node, and configured to transmit the signal of the second signal end to the pull-up node in response to a signal of the reset end, the reset circuit being connected between the input circuit and the pull-down circuit, wherein, according to a cascade relationship of the cascading shift registers, the second signal ends of the cascading shift registers at a first stage to an N-th stage are sequentially connected to N-th signal terminal to first signal terminal.

5. The shift register circuit according to claim 4, wherein:

the pull-down circuit of the shift register circuit comprises a first pull-down circuit and a second pull-down circuit, the second signal end comprising a first sub-signal end and a second sub-signal end;

the first pull-down circuit comprises: an eighth switching element provided with a control end connected to the pull-down node, a first end connected to the output end, and a second end connected to the first sub-signal end, and configured to transmit a signal of the first sub-signal end to the output end in response to the signal of the pull-down node;

the second pull-down circuit comprises: a seventh switching element provided with a control end connected to the pull-down node, a first end connected to the pull-up node, and a second end connected to the second signal end, and configured to transmit a signal of the second sub-signal end to the pull-up node in response to the signal of the pull-down node; and the reset circuit of the shift register circuit is connected to the reset end, the pull-up node, and the second sub-signal end, and is configured to transmit the signal of the second sub-signal end to the pull-up node in response to a signal of the reset end.

6. The shift register circuit according to claim 5, wherein:

the signal of the first sub-signal end comprises a first signal to an N-th signal received from the first signal terminal to the N-th signal terminal;

according to the cascade relationship of the cascading shift registers, the first sub-signal ends of the cascading shift registers at the first stage to the N-th stage are sequentially connected to the N-th signal terminal to the first signal terminal; and according to the cascade relationship of the cascading shift registers, the second sub-signal ends of the cascading shift registers at the first stage to the N-th stage are connected to the first signal terminal.

7. The shift register circuit according to claim 5, wherein:

the signal of the first sub-signal end comprises a first signal to an (N+1)-th signal received from the first signal terminal to an (N+1)-th signal terminal;

according to the cascade relationship of the cascading shift registers, the first sub-signal ends of the cascading shift registers at the first stage to the N-th stage are sequentially connected to the (N+1)-th signal terminal to a second signal terminal; and according to the cascade relationship of the cascading shift registers, the second sub-signal ends of the cascading shift registers at the first stage to the N-th stage are sequentially connected to the N-th signal terminal to the first signal terminal.

8. The shift register circuit according to claim 5, wherein:

the input circuit comprises: a first switching element provided with a control end, a first end connected to an input end, and a second end connected to the pull-up node; and the compensation circuit comprises: a tenth switching element provided with a control end connected to the input end, a first end connected to a compensation end, and a second end connected to the pull-up node.

9. The shift register circuit according to claim 5, wherein:

the input circuit comprises: a first switching element provided with a control end connected to an input end, a first end connected to the first signal end, and a second end connected to the pull-up node; and the compensation circuit comprises: a tenth switching element provided with a control end connected to the input end, a first end connected to a compensation end, and a second end connected to the pull-up node.

10. The shift register circuit according to claim 5, wherein:

the input circuit comprises: a first switching element provided with a control end, a first end connected to an input end, and a second end connected to the pull-up node; and the compensation circuit comprises:

a tenth switching element provided with a first end connected to a compensation end, and a second end connected to the pull-up node;

an eleventh switching element provided with a control end and a first end connected to a second phase clock signal end, and a second end connected to a control end of the tenth switching element; and a twelfth switching element provided with a control end connected to the pull-down node, a first end connected to the second end of the eleventh switching element, and a second end connected to the second signal end.

11. The shift register circuit according to claim 5, wherein:

the input circuit comprises: a first switching element provided with a control end, a first end connected to an input end, and a second end connected to the pull-up node; and the compensation circuit comprises:

a tenth switching element provided with a first end connected to a compensation end;

an eleventh switching element provided with a control end and a first end connected to the compensation end, and a second end connected to a control end of the tenth switching element;

a second storage capacitor provided with a first end connected to a second end of the tenth switching element, and a second end connected to the pull-up node; and a twelfth switching element provided with a control end connected to the pull-down node, a first end connected to a second end of the eleventh switching element, and a second end connected to the second signal end.

12. The shift register circuit according to claim 5, wherein:

the output circuit comprises:

a second switching element provided with a control end connected to the pull-up node, a first end connected to the first phase clock signal end, and a second end connected to the output end; and a first storage capacitor provided with a first end connected to the pull-up node, and a second end connected to the output end;

the pull-down control circuit comprises:

a third switching element provided with a control end, a first end connected to the first signal end, and a second end connected to the pull-down control node;

a fourth switching element provided with a control end connected to the pull-down control node, a first end connected to the first signal end, and a second end connected to the pull-down node;

a fifth switching element provided with a control end connected to the pull-up node, a first end connected to the pull-down control node, and a second end connected to the second signal end; and a sixth switching element, provided with a control end connected to the pull-up node, a first end connected to the pull-down node, and a second end connected to the second signal end;

the pull-down circuit comprises:

a seventh switching element provided with a control end connected to the pull-down node, a first end connected to the pull-up node, and a second end connected to the second signal end; and an eighth switching element provided with a control end connected to the pull-down node, a first end connected to the output end, and a second end connected to the second signal end; and the reset circuit comprises: a ninth switching element provided with a control end connected to the reset end, a first end connected to the pull-up node, and a second end connected to the second signal end.

13. A display device, comprising:

a shift register circuit comprising N cascading shift registers, wherein N is an integer greater than one and any one of the N cascading shift registers comprises:

an input circuit connected to a pull-up node and configured to provide a signal to the pull-up node;

a compensation circuit connected to the pull-up node and configured to transmit a compensation signal to the pull-up node, the compensation circuit being connected to the input circuit;

an output circuit connected to the pull-up node, an output end, and a first phase clock signal end, and configured to transmit a signal of the first phase clock signal end to the output end in response to a signal of the pull-up node, the output circuit being connected to the input circuit and the compensation circuit;

a pull-down control circuit connected to a first signal end, a pull-down control node, a pull-down node, the pull-up node, and a second signal end, and configured to transmit a signal of the second signal end to the pull-down node and the pull-down control node in response to the signal of the pull-up node, and transmit a signal of the first signal end to the pull-down control node and the pull-down node in response to the signal of the first signal end, the pull-down control circuit being connected to the input circuit;

a pull-down circuit connected to the pull-up node, the pull-down node, the output end, and the second signal end, and configured to transmit the signal of the second signal end to the pull-up node and the output end in response to a signal of the pull-down node, the pull-down circuit being connected between the compensation circuit and the output circuit; and a reset circuit connected to a reset end, the second signal end, and the pull-up node, and configured to transmit the signal of the second signal end to the pull-up node in response to a signal of the reset end, the reset circuit being connected between the input circuit and the pull-down circuit, wherein, according to a cascade relationship of the cascading shift registers, the second signal ends of the cascading shift registers at a first stage to an N-th stage are sequentially connected to N-th signal terminal to first signal terminal.

14. The display device according to claim 13, wherein:

the pull-down circuit of the shift register circuit comprises a first pull-down circuit and a second pull-down circuit, the second signal end comprises a first sub-signal end and a second sub-signal end;

the first pull-down circuit comprises: an eighth switching element provided with a control end connected to the pull-down node, a first end connected to the output end, and a second end connected to the first sub-signal end, and configured to transmit a signal of the first sub-signal end to the output end in response to the signal of the pull-down node;

the second pull-down circuit comprises: a seventh switching element provided with a control end connected to the pull-down node, a first end connected to the pull-up node, and a second end connected to the second signal end, and configured to transmit a signal of the second sub-signal end to the pull-up node in response to the signal of the pull-down node; and the reset circuit of the shift register circuit is connected to the reset end, the pull-up node, and the second sub-signal end, and configured to transmit the signal of the second sub-signal end to the pull-up node in response to a signal of the reset end.

15. The display device according to claim 14, wherein:

the signal of the first sub-signal end comprises a first signal to an N-th signal received from the first signal terminal to the N-th signal terminal;

according to the cascade relationship of the cascading shift registers, the first sub-signal ends of the cascading shift registers at the first stage to the N-th stage are sequentially connected to the N-th signal terminal to the first signal terminal; and according to the cascade relationship of the cascading shift registers, the second sub-signal ends of the cascading shift registers at the first stage to the N-th stage are connected to the first signal terminal.

16. The display device according to claim 14, wherein:

the signal of the first sub-signal end comprises a first signal to an (N+1)-th signal received from the first signal terminal to an (N+1)-th signal terminal;

according to the cascade relationship of the cascading shift registers, the first sub-signal ends of the cascading shift registers at the first stage to the N-th stage are sequentially connected to the a (N+1)-th signal terminal to a second signal terminal; and according to the cascade relationship of the cascading shift registers, the second sub-signal ends of the cascading shift registers at the first stage to the N-th stage are sequentially connected to the N-th signal terminal to the first signal terminal.

* * * * *